US012557856B2

(12) United States Patent
Perry et al.

(10) Patent No.: US 12,557,856 B2
(45) Date of Patent: Feb. 24, 2026

(54) GARMENT WAISTBAND SYSTEM AND METHOD

(71) Applicant: HBI Branded Apparel Enterprises, LLC, Winston-Salem, NC (US)

(72) Inventors: Tasha Perry, Winston-Salem, NC (US); Jessica Singleton, Burlington, NC (US)

(73) Assignee: HBI Branded Apparel Enterprises, LLC, Winston-Salem, NC (US)

( * ) Notice: Subject to any disclaimer, the term of this patent is extended or adjusted under 35 U.S.C. 154(b) by 0 days.

(21) Appl. No.: 18/486,040

(22) Filed: Oct. 12, 2023

(65) Prior Publication Data

US 2024/0122271 A1 Apr. 18, 2024

Related U.S. Application Data

(60) Provisional application No. 63/379,262, filed on Oct. 12, 2022.

(51) Int. Cl.
*A41B 9/14* (2006.01)
*A41F 9/00* (2006.01)

(52) U.S. Cl.
CPC . *A41B 9/14* (2013.01); *A41F 9/00* (2013.01)

(58) Field of Classification Search
CPC ... A41B 9/14; A41F 9/00; A41F 11/00; A41F 11/16
See application file for complete search history.

(56) References Cited

U.S. PATENT DOCUMENTS 644,557 A * 2/1900 Koch ..... A41F 11/16 24/712
695,549 A * 3/1902 Garland ..... A41F 9/002 2/322
1,202,211 A * 10/1916 Page ..... A41F 9/00 2/236
1,327,035 A * 1/1920 Greenwald ..... A41F 9/002 2/338
1,519,877 A * 12/1924 Piotrowski ..... A41D 1/04 2/300
1,868,212 A * 7/1932 Lewis ..... A41F 9/00 2/236

(Continued)

FOREIGN PATENT DOCUMENTS

CA 341641 A * 5/1934
EP 3369404 A1 9/2018

OTHER PUBLICATIONS

European Search Report for corresponding European Application No. 23203251.6, mailed Feb. 22, 2024, 13 pages.

*Primary Examiner* — Heather Mangine
(74) *Attorney, Agent, or Firm* — Husch Blackwell LLP

(57) ABSTRACT

A waistband for use in a garment is provided. The waistband may have a flexible body including a first portion imparted with a first width dimension, a second portion imparted with a second width dimension, and a transition portion imparted with a third width dimension. The transition portion may be disposed between the first portion and the second portion. The first width dimension of the first portion may be less than the second width dimension of the second portion. Further, the third width dimension of the transition portion may be no greater than about the second width dimension.

9 Claims, 26 Drawing Sheets

(56) References Cited

U.S. PATENT DOCUMENTS 2,099,541 A * 11/1937 Spain ..... A41B 9/02 450/149
2,343,823 A * 3/1944 Vogt ..... A41F 11/16 450/106
2,353,567 A * 7/1944 Key ..... A41F 9/02 2/311
2,955,599 A * 10/1960 Blatt ..... A41C 1/10 450/155
3,171,409 A * 3/1965 Cetrone ..... A61F 5/028 2/311
3,511,245 A * 5/1970 Jaggers, Jr. ..... A41F 11/18 450/106
3,515,143 A * 6/1970 Black ..... A41C 1/02 450/109
3,527,231 A * 9/1970 Catanese ..... A41C 3/10 450/86
3,769,987 A * 11/1973 Markowitz ..... A41C 3/0021 450/60
3,909,851 A * 10/1975 Garrou ..... A41B 11/14 2/409
4,229,835 A * 10/1980 Shaw ..... A41B 9/001 2/221
4,400,832 A * 8/1983 Kinder ..... A41B 9/08 128/100.1
4,506,390 A * 3/1985 Stern ..... A41D 1/21 2/221
4,523,337 A * 6/1985 Leibowitz ..... A41B 9/14 2/237
5,060,315 A * 10/1991 Ewing ..... A41B 9/005 2/400
5,153,939 A * 10/1992 Howe ..... A41D 31/02 2/164
5,403,271 A * 4/1995 Saunders ..... A63B 21/4009 602/60
5,823,012 A * 10/1998 Hacskaylo ..... D04B 1/24 66/171
6,289,518 B1 * 9/2001 O'Connor ..... A41F 9/002 2/311
6,546,564 B1 * 4/2003 Palmer ..... A41B 9/14 2/409
6,567,991 B1 * 5/2003 Holslag ..... A42C 5/02 2/181.4
6,772,446 B1 * 8/2004 Black ..... A41B 9/04 2/400
6,839,913 B2 * 1/2005 Villalobos ..... A41D 1/06 2/400
8,407,815 B2 * 4/2013 Meschter ..... A41F 9/025 2/238
8,661,568 B1 * 3/2014 O'Brien ..... A41B 11/14 2/409
9,717,282 B1 * 8/2017 Hays ..... A41D 1/00
11,382,373 B2 * 7/2022 Buell ..... A41F 9/002
11,528,945 B2 * 12/2022 Aiello ..... A61F 13/8405
2005/0050615 A1 * 3/2005 Stickney ..... A41F 9/002 2/311
2006/0021116 A1 * 2/2006 Protting ..... A41F 9/02 2/404
2008/0295225 A1 * 12/2008 Hendrickson ..... A41D 1/21 2/237
2012/0117705 A1 * 5/2012 Hawkins ..... A41D 13/065 2/23
2013/0007947 A1 * 1/2013 Moore ..... A41D 31/185 2/236
2015/0173424 A1 * 6/2015 Carney ..... A41D 1/21 450/155
2016/0066679 A1 * 3/2016 Capps ..... A45F 3/005 224/660
2017/0354531 A1 * 12/2017 Matsuo ..... A41C 1/08
2018/0007977 A1 * 1/2018 Windenberger ..... A41C 1/10
2021/0112889 A1 * 4/2021 Bentz ..... A41D 1/08
2021/0298396 A1 * 9/2021 Lazic ..... A41F 9/00
2022/0192280 A1 * 6/2022 Burton ..... D04B 1/24
2022/0264968 A1 * 8/2022 Bentz ..... A41D 1/06
2022/0400793 A1 * 12/2022 Lundine ..... A41D 20/00
2023/0218017 A1 * 7/2023 Harrison ..... A41D 1/21 2/228
2023/0276863 A1 * 9/2023 Chen ..... A41F 17/00 2/401
2023/0276882 A1 * 9/2023 Hetzel ..... A41F 9/002 2/321
2023/0292865 A1 * 9/2023 Florio ..... A41F 9/002 2/338
2023/0320443 A1 * 10/2023 Roth ..... A41D 27/207 2/253
2024/0122271 A1 * 4/2024 Perry ..... A41B 17/005
2024/0225162 A1 * 7/2024 Teague ..... A41F 9/02
2024/0358096 A1 * 10/2024 Lazic ..... A41D 1/14

* cited by examiner

GARMENT WAISTBAND SYSTEM AND METHOD

CROSS-REFERENCE TO RELATED APPLICATIONS

This application claims priority to U.S. Patent Application Ser. No. 63/379,262, filed Oct. 12, 2022, entitled "GARMENT WAISTBAND," which is incorporated herein by reference in its entirety.

FIELD OF INVENTION

The present disclosure relates generally to garments, and more particularly to a waistband and fabrics for use in garments.

BACKGROUND

When purchasing garments, consumers use a variety of criteria in deciding what garments to purchase, including the garments' fit, functionality, appearance, performance, comfort, and price. However, in the minds of consumers, many garments fail to live up to at least one of these criteria. For garment manufacturers, much of the difficulty in providing garments that satisfy consumers results from the type of fabrics and materials that comprise the garments. The fabrics and materials impact not only how consumers perceive the garments, but also whether the garments align with the criteria important to the consumers. For example, it can be particularly difficult to manufacture clothing that is sufficiently breathable, provides support to various parts of the consumer's body, and yet does not "ride up" or "ride down" the consumer's body as the garment is worn.

For garments having waist openings, the waistband is a key component that drives the fit, performance, and functionality of the garment as a whole. Elastomers are typically used when constructing waistbands. Historically, garment manufacturers have only considered the elastomers from a one-dimensional perspective, e.g., the amount of the elastomer utilized in the waistband. This can be problematic for consumers because the result is a waistband (and thus a garment) that does not conform to the dimensions of the human body. Waistbands that do not conform to the human body can bunch up or fold over during wear, and/or cause the garment to "ride up" or "ride down" the consumer's body. Such fabric movement can be relatively uncomfortable or even embarrassing for the consumer.

In addition, many garments are constructed of high-friction materials. Such materials can severely impact the consumer's comfort when wearing the garment because the materials can lead to chafing as the high-friction materials rub against the consumer's skin. Not only is chafing uncomfortable, but it can also lead to bacterial or fungal infections if uncontrolled.

SUMMARY

Provided herein are several embodiments of a waistband and an undergarment designed to overcome many of the shortcomings and limitations of the prior art waistbands and garments discussed above. The waistband may be incorporated into any type of garment that includes a waist opening, such as the undergarment described herein.

The waistband provided herein is designed to conform to a wearer's body. Generally, the elongation and modulus of an elastomer provided around the circumference of the waistband have been modified to create a waistband that can provide additional support in some portions and additional flexibility in other portions of the waistband. Providing different regions of support and flexibility may be accomplished by providing a waistband with a first portion that is narrower in width than a second portion of the waistband. The first, narrower portion of the waistband may be designed to help prevent elastomer rollover when a wearer of the garment bends, moves, or otherwise manipulates or impacts the waistband. In comparison, the second, wider portion of the waistband may provide support for the wearer and help prevent the garment from pulling down or rising up on the wearer's body during use (i.e., while wearing the garment).

If provided in a garment, the first portion of the waistband may be positioned at least partially in a front region of the garment, while the second portion may be positioned at least partially in one or both side regions and/or a back region of the garment. Alternatively, the first portion may be positioned at least partially in the front region of the garment, the second portion may be positioned at least partially in the back region, and a transition portion may be disposed between the first portion and the second portion. In another embodiment, the first portion of the waistband may be provided adjacent to the abdomen of the wearer when the garment including the waistband is worn, while the second portion may be provided adjacent to the back and buttocks of the wearer (e.g., on an opposing side of the waistband).

In addition, the garment incorporating the waistband may comprise materials designed to protect the wearer from chafing. The garment may be defined by a first zone and a second zone, the first zone including materials defined by a first coefficient of friction, and the second zone including materials defined by a second coefficient of friction, whereby the first coefficient of friction is different from the second coefficient of friction. Optionally, or preferably, the second coefficient of friction is less than the first coefficient of friction to provide a garment with anti-chafing capabilities. In addition, the first zone may comprise a first material, and the second zone may comprise a second material that is different with respect to the first material. In some embodiments, the second material is provided in a form that allows gases to permeate away from the wearer's skin, which can help prevent moisture buildup on the wearer's body. In some instances, the material of the first zone may comprise a jersey fabric, while the material of the second zone may comprise a mesh fabric.

In some embodiments, the garment may be defined by a first zone, a second zone, and a third zone, each zone having a different coefficient of friction with respect to each other.

In one aspect, a waistband for use in a garment is provided. The waistband is provided in the form of a flexible body including a first portion imparted with a first width and a first length, a second portion imparted with a second width and a second length different from the first width and first length, and a transition portion disposed between the first and second portions. The transition portion may be imparted with a third width. The first width may be less than the second width. Further, the third width may be at least about the first width and no greater than about the second width.

In some embodiments, the transition portion may be imparted with a third length, the second length may be about 200% greater than the first length, and the third length may be no greater than the second length.

In other embodiments, the first width may be about 0% to about 35% smaller than the second width.

In yet other embodiments, the waistband may further comprise an attachment mechanism designed to couple the first end and the second end. In such embodiments, the attachment mechanism may be provided as at least one of a flatseam, an adhesive, a bonding strip, or a thread.

In some embodiments, the waistband may be seamless.

In other embodiments, when the waistband is in a closed configuration (e.g., the waistband extends in an unbroken manner), the waistband may have an ovular or rounded shape.

In yet other embodiments, the first portion may have a first thickness, the transition portion may have a second thickness, and the second portion has a third thickness, each of the first thickness, the second thickness, and the third thickness may be different with respect to each other.

In some embodiments, the third width of the transition portion may gradually taper between the first portion and the second portion.

In other embodiments, the transition portion may further include a fourth width and a fifth width, the fourth width may be approximately equal to the first width and the fifth width may be approximately equal to the second width. In such embodiments, the fourth width may gradually increase to the fifth width.

In another aspect, a performance undergarment is provided. The performance undergarment may comprise a waist opening at a first end and at least one leg opening (and in some instances, a first leg opening and a second leg opening) at a second end that is opposite the first end. The performance undergarment may further comprise a body that includes a first zone and a second zone, the first zone and the second zone may be provided in the form of a first fabric and a second fabric, respectively. The first fabric may be imparted with a first coefficient of friction that is greater than a second coefficient of friction of the second fabric. The performance undergarment may also comprise a waistband that is coupled to the body. The waistband may include at least a first portion having a first width and a second portion having a second width that is different from the first width.

In some embodiments, the first portion of the waistband may be positioned at least partially in a front region of the undergarment. Further, the second portion of the waistband may be positioned at least partially in a back region (e.g., opposing side of the undergarment with respect to the front region) of the performance undergarment.

In other embodiments, the body may include a third zone comprising a third fabric imparted with a third coefficient of friction.

In yet other embodiments, the second coefficient of friction may be less than the first coefficient of friction and the third coefficient of friction.

In some embodiments, the performance undergarment may include at least one fabric that may impart the performance undergarment with at least one of the following beneficial aspects: temperature regulation properties, UV protection properties, moisture wicking properties, breathability, or antimicrobial properties.

In yet another aspect, a method of creating an undergarment is provided. The method may include a step of providing a waistband including at least a first portion imparted with a first width and a second portion having a second width, the first width and second width being different with respect to each other. The method may also include a step of providing a body of an undergarment having at least one side section, at least one front section, at least one back section, a pouch, and a gusset. Further, the method may include arranging the waistband, the side section, the front section, the back section, the pouch, and the gusset such that a first zone and a second zone may be provided in the body of the undergarment. Yet further, the method may include coupling the waistband to the body of the undergarment.

In some embodiments, the waistband may be provided as at least one of a braided elastic, a knit elastic, a woven elastic, or a folded-over elastic.

In other embodiments, the waistband may include a transition portion positioned between the first portion and the second portion, and the transition portion may be imparted with a third width that is different from the first portion and second portion.

In yet other embodiments, the first zone may include the at least one front section and at least a first segment of the at least one back section. The second zone may include the pouch, the gusset, and at least a second segment of the at least one side section.

In some embodiments, the waistband may be coupled to the body of the undergarment via a seam, adhesive, bonding, or combinations thereof.

These and other aspects and advantages of the present embodiments will become apparent to those skilled in the art after considering the following detailed description in connection with the accompanying drawings.

Figure 1:
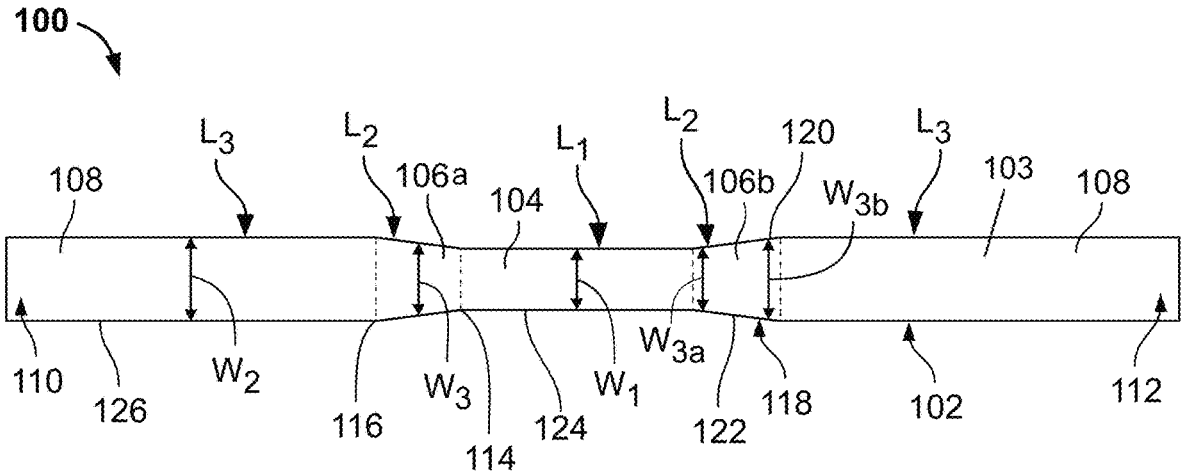
FIG. 1 is a front elevational view of a waistband for a garment in an open configuration, the waistband constructed according to the teachings herein.

While the disclosure is susceptible to various modifications and alternative forms, a specific embodiment thereof is shown by way of example in the drawings and will herein be described in detail. It should be understood, however, that the drawings and detailed description presented herein are not intended to limit the disclosure to the particular embodiment disclosed, but to the contrary, the intention is to cover all modifications, equivalents, and alternatives falling within the spirit and scope of the present disclosure as defined by the appended claims.

DETAILED DESCRIPTION

Before any embodiments are described in detail, it is to be understood that the disclosure is not limited in its application to the details of construction and the arrangement of components set forth in the following description or illustrated in the following drawings, which is limited only by the claims that follow the present disclosure. The disclosure is capable of other embodiments, and of being practiced, or of being carried out, in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following description is presented to enable a person skilled in the art to make and use embodiments of the disclosure. Various modifications to the illustrated embodiments will be readily apparent to those skilled in the art, and the generic principles herein can be applied to other embodiments and applications without departing from embodiments of the disclosure. Thus, embodiments of the disclosure are not intended to be limited to embodiments shown but are to be accorded the widest scope consistent with the principles and features disclosed herein. The following detailed description is to be read with reference to the figures, in which like elements in different figures have like reference numerals. Skilled artisans will recognize the examples provided herein have many useful alternatives and fall within the scope of embodiments of the disclosure.

Additionally, while the following discussion may describe features associated with specific devices or embodiments, it is understood that additional devices and/or features can be used with the described systems and methods and that the discussed devices and features are used to provide examples of possible embodiments, without being limited.

The present disclosure is directed to a waistband that can be coupled to or incorporated into various garments, e.g., garments having a waist opening. Such garments could include underwear, shorts, pants, sweatshirts, hoodies, body suits, innerwear, outerwear, and the like. If the garment incorporating the waistband is provided as an undergarment, the type of undergarment is not particularly limited and may include boxers, briefs, boxer briefs, bikini shorts, high-waisted shorts, low-waisted shorts, thongs, panties, compression shorts, and the like.

Also provided herein are embodiments of a performance undergarment incorporating the above-described waistband. Generally, the undergarment may be defined by a first zone and a second zone. The materials comprising at least the second zone of the undergarment may functionally provide the undergarment with anti-chafing capabilities that make the undergarment more comfortable for the wearer.

FIG. 1 illustrates a waistband 100 designed for use with a garment. The waistband 100 is depicted in FIG. 1 in an open configuration, whereby the waistband 100 is unattached to a garment and is substantially flat. The waistband 100 may be provided in the form of an elongate flexible body 102. The flexible body 102 may comprise a first portion 104, a first transition portion 106*a* and a second transition portion 106*b*, a second portion 108, a first end 110, and a second end 112 at the opposite end of the body 102 with respect to the first end 110. Generally, the flexible body 102 may be substantially symmetrical, wherein the right side and the left side of the waistband 100 are substantially mirror images of each other. In alternative embodiments, however, the flexible body 102 may be provided in alternative shapes and configurations wherein this general symmetry is not provided.

Further, in a preferred embodiment, the first transition portion 106*a* and the second transition portion 106*b* may be imparted with the same or substantially the same dimensions. In particular, it should be understood that when one of the transition portions 106 is described herein, the other of the transition portions may include similar properties to impart similar wear characteristics to the waistband 100 on opposing sides of the first portion 104 and in a manner to conform to a user's body in a symmetrical or substantially symmetrical way. "One or more of" the transition portions may mean a single transition portion 106*a* or 106*b*, or may mean both of the first transition portion 106*a* and the second transition portion 106*b*. Further, in other embodiments, small variations in the dimensions between the first transition portion 106*a* and the second transition portion 106*b* may be intentionally included to impart an additional benefit or may exist by virtue of the fabric construction, manufacturing, or joining process.

The flexible body 102 of the waistband 100 may be composed of fabrics, fibers, or materials that have elastic properties. For example, the flexible body 102 may be provided in the form of a natural elastomer, such as rubber, or a synthetic elastomer, such as spandex, elastane, or LYCRA®, and combinations thereof. As known in the art, the elastomer may be provided as cores that are bound or surrounded by a natural and/or a synthetic textile, including a polyester, a nylon, or a cotton fabric. The elastomer and textile combination may then be knitted, woven, or otherwise constructed into a waistband. The elastomer may be combined with the textile in various amounts; generally, the higher content of elastomer included in the flexible body 102, the greater the overall elasticity of the flexible body 102. For example, the elastomer may comprise at least about 5%, at least about 10%, at least about 15%, at least about 20%, or at least about 25%, or at least about 30% of the flexible body 102. Alternatively, the elastomer may comprise no greater than about 40%, no greater than about 35%, no greater than about 30%, no greater than about 25%, no greater than about 20%, or no greater than about 15%, or no greater than about 10% of the flexible body 102. As an additional example, the elastomer may comprise at least 5%, or at least 10%, or at least 15%, or at least 20%, or at least 25%, or at least 30% of the flexible body 102. Alternatively, the elastomer may comprise no greater than 40%, no greater than 35%, no greater than 30%, no greater than 25%, no greater than 20%, no greater than 15%, or no greater than 10% of the flexible body 102. In addition, the elastomer comprising the flexible body 102 may be provided in the form of a braided elastic, a knit elastic, a woven elastic, a fold-over elastic, or the like.

In some embodiments, the flexible body 102 is provided in the form of nylon, spandex, polyester, natural rubber, and combinations thereof. For example, the flexible body 102 may comprise a nylon-spandex composition, a polyester-spandex composition, a rubber-nylon composition, a rubber-polyester composition, and the like. In a preferred embodiment, the flexible body 102 may comprise a combination of nylon, polyester, and spandex. In one aspect, the overall fabric composition of the flexible body 102 may comprise about 66% nylon, about 24% polyester, and about 10% spandex. In another aspect, the overall fabric composition of the flexible body 102 may comprise 66% nylon, 24% polyester, and 10% spandex. In yet another aspect, the overall fabric composition of the flexible body 102 may comprise at least about 50% nylon, at least about 20% polyester, and at least about 5% of an elastomer. In a further aspect, the flexible body 102 may comprise at least 50% nylon, at least 20% polyester, and at least about 5% of an elastomer.

In some embodiments, the waistband 100 may be provided in a form that is substantially free, or entirely free, of an elastomer. In such embodiments, the flexible body 102 may be provided with a knit structure that provides flexibility to the waistband 100.

In some embodiments, the flexible body 102 may be provided with a cover 103. The cover 103 may be designed to substantially surround the flexible body 102 and may be coupled to the flexible body 102 via an adhesive, bonding, one or more seams, or other attachment mechanism. In some embodiments, the cover may comprise a soft-touch or soft-feel fabric (e.g., a texturized fabric or silicone-treated fabric). As such, the cover 103 may provide a surface that feels pleasant to the wearer when the cover contacts the wearer's skin.

The first portion 104, the transition portions 106*a*, 106*b*, and the second portion 108 defining the waistband 100 may collectively comprise the flexible body 102. As depicted in FIG. 1, the second portion 108 is shown as two separate pieces. However, the separate pieces of the second portion 108 are joined such that the waistband 100 forms a continuous loop when the waistband 100 is assembled in the closed configuration (see FIGS. 2-7). It is contemplated that the waistband 100 may be provided as a unitary structure or continuous loop such that the waistband 100 is not in the open configuration during normal wear thereof.

The waistband 100 is imparted with various dimensions and is constructed of specific materials in order to achieve some of the benefits discussed herein. In some aspects, the first portion 104 may be imparted with a first width $W_1$ dimension along the entirety thereof, the second portion 108 may be imparted with a second width $W_2$ dimension along the entirety thereof, and the first and second transition portions 106*a*, 106*b* may each be imparted with a third width $W_3$ dimension that tapers from a first side to a second side. Only the dimensions of the second transition portion 106*b* are shown and it should be appreciated that each of the dimensions of the first transition portion 106*a* is substantially the same as or equivalent to each of the dimensions of the second transition portion 106*b* (although in some embodiments, one or more dimensions of the first transition portion 106*a* are different with respect to one or more dimensions of the second transition portion 106*b*). One or more of the first transition portion 106*a* and/or the second transition portion 106*b* may represent a section of the waistband 100 imparted with a gradually increasing and varying width $W_3$ dimension. In a preferred embodiment, as illustrated, the first width $W_1$ dimension may be less than the second width $W_2$ dimension. In some embodiments, the first width $W_1$ dimension and the second width $W_2$ dimension may be about the same or the same. For example, a ratio of the first width $W_1$ dimension to the second width $W_2$ dimension may be at least about 1:1, or at least about 1:1.1, or at least about 1:1.2, or at least about 1:1.3, or at least about 1:1.4, or at least about 1:1.5. As an additional example, a ratio of the first width $W_1$ dimension to the second width $W_2$ dimension may be at least 1:1, or at least 1:1.1, or at least 1:1.2, or at least 1:1.3, or at least 1:1.4, or at least 1:1.5. In other embodiments, when comparing the first width $W_1$ dimension and the second width $W_2$ dimension, the difference between the first width $W_1$ dimension and the second width $W_2$ dimension may be about 0% to about 35%, or about 10% to about 30%, or about 15% to about 30%, or about 20% to about 25%. For example, when comparing the first width $W_1$ dimension and the second width $W_2$ dimension, the difference between the first width $W_1$ dimension and the second width $W_2$ dimension may be 0% to 35%, or 10% to 30%, or 15% to 30%, or 20% to 25%.

In some embodiments, the first portion 104 may be imparted with a substantially constant width $W_1$ dimension throughout its body and the second portion 108 may be imparted with a substantially constant width $W_2$ dimension throughout its body. In other embodiments, the width $W_1$, $W_2$ dimensions may vary throughout the bodies of the first and second portions 104, 108.

The first portion 104 of the body 102 of the waistband 100 may be defined by or imparted with a first elastic modulus and the second portion 108 may be defined by or imparted with a second elastic modulus. The first and second elastic modulus values may be about the same, the same, or they may be different with respect to each other. For example, the difference between the first modulus value and the second modulus value may be about 0% to about 30%, or about 5% to about 25%, or about 10% to about 20%. As an additional example, the difference between the first modulus value and the second modulus value may be 0% to 30%, or 5% to 25%, or 10% to 20%. In some embodiments, the first elastic modulus is less than the second elastic modulus. For example, the second modulus value may be at least about 5% greater, or at least about 10% greater, or at least about 15% greater, or at least about 20% greater, or at least about 25% greater, or at least about 30% greater than the first modulus value. As an additional example, the second modulus value may be at least 5% greater, or at least 10% greater, or at least 15% greater, or at least 20% greater, or at least 25% greater, or at least 30% greater than the first modulus value.

In some embodiments, at least one of the first portion 104, the transition portions 106*a*, 206*b*, and/or the second portion 108 may be substantially rigid. In such embodiments, the difference of the elastic modulus values of the at least one substantially rigid portion of the waistband 100, compared to the more flexible portions of the waistband 100, may be at least about 40%, or at least about 50%, or at least about 60%, or at least about 70%, or at least about 80%, or at least about 90%, or at least about 100%. As an additional example, the difference of the elastic modulus values of the at least one substantially rigid portion of the waistband 100, compared to the more flexible portions of the waistband 100, may be at least 40%, or at least 50%, or at least 60%, or at least 70%, or at least 80%, or at least 90%, or at least 100%

The first portion 104 of the body 102 of the waistband 100 may be imparted with a first elongation value and the second portion 108 may be imparted with a second elastic elongation value that is different than the first elongation value. For example, the difference between the first elongation value and the second elongation value may be about 0% to about 30%, or about 5% to about 25%, or about 10% to about 20%. As an additional example, the difference between the first elongation value and the second elongation value may be 0% to 30%, or 5% to 25%, or 10% to 20%. In some embodiments, the first elongation value may be greater than the second elongation value. For example, the first elongation value may be at least about 5% greater, or at least about 10% greater, or at least about 15% greater, or at least about 20% greater, or at least about 25% greater, or at least about 30% greater than the second elongation value. In other embodiments, the first elongation value may be at least 5% greater, or at least 10% greater, or at least 15% greater, or at least 20% greater, or at least 25% greater, or at least 30% greater than the second elongation value.

In some embodiments, at least one of the first portion 104, the transition portions 106*a*, 106*b*, and/or the second portion 108 may be substantially rigid. In such embodiments, the difference of the elongation values of the at least one substantially rigid portion of the waistband 100, compared to the more flexible portions of the waistband 100, may be at least about 40%, or at least about 50%, or at least about 60%, or at least about 70%, or at least about 80%, or at least about 90%, or at least about 100%. As an additional example, the difference of the elongation values of the at least one substantially rigid portion of the waistband 100, compared to the more flexible portions of the waistband 100, may be at least 40%, or at least 50%, or at least 60%, or at least 70%, or at least 80%, or at least 90%, or at least 100%.

As stated above, in a preferred embodiment, at least one segment or segments of the first portion 104 of the waistband 100 may be narrower than at least one segment or segments of the second portion 108 (e.g., the value of the first width $W_1$ dimension is less than the second width $W_2$ dimension), which may give rise to the elastic modulus and elongation differences described above. In such an embodiment, the first portion 104 of the body 102 of the waistband 100 may help prevent elastic rollover when the waistband 100 is incorporated into a garment. For example, if the first portion 104 is provided in a location where the wearer of the garment can bend forward or sideways, the first portion 104 may help prevent elastic rollover; at the same time, the second portion 108 may provide support to the garment to help prevent the garment from riding up or riding down the wearer's body. In alternative embodiments, the difference in the first and second elastic modulus values may arise from a difference in the type of textiles or elastomers used when constructing the portions 104, 108.

One or more of the transition portions 106*a*, 106*b* may be positioned and located between the first and second portions 104, 108, respectively. Generally, one or more of the transition portions 106*a*, 106*b* may have a varying width dimension that tapers outwardly along its length dimension. For example, the width dimension of one or more of the transition portions 106*a*, 106*b* (i.e., the third width $W_3$ dimension) may be measured as a first width $W_1$ dimension at a side 114 where each of the transition portions 106*a*, 106*b* abut the first portion 104 and may also be about the second width $W_2$ dimension at a side 116 where each of the transition portions 106*a*, 106*b* abut the second portion 108.

In some embodiments, one or more of the transition portions 106*a*, 106*b* may be imparted with a fourth width $W_{3a}$ dimension and a fifth width $W_{3b}$ dimension. The fourth width $W_{3a}$ dimension may be about or substantially the same as the first width $W_1$ dimension, and the fifth width $W_{3b}$ dimension may be about or substantially the same as the second width $W_2$ dimension. Thus, the fourth width $W_{3a}$ dimension and the fifth width $W_{3b}$ dimension may represent the approximate maximum and minimum values of the third width $W_3$ dimension of each of the transition portions 106*a*, 106*b*. In such embodiments, the width dimension of one or more of the transition portions 106*a*, 106*b* may increase from the fourth width $W_{3a}$ dimension to the fifth width $W_{3b}$ dimension. The increase of the width dimension of one or more of the transition portions 106*a*, 106*b* between the fourth width $W_{3a}$ dimension to the fifth width $W_{3b}$ dimension may be gradual. For example, the third width $W_3$ dimension may increase at a rate of 1 mm for a defined change across the length dimension of one or more of the transition portions 106*a*, 106*b* until achieving the value of the fifth width $W_{3b}$ dimension. For example, the defined change in the length dimension across one or more of the transition portions 106*a*, 106*b* may be at least about 1 mm, or at least about 2 mm, or at least about 3 mm, or at least about 4 mm, or at least about 5 mm, or at least about 10 mm. As an additional example, the defined change in the length dimension across one or more of the transition portions 106*a*, 106*b* may be at least 1 mm, at least 2 mm, at least 3 mm, at least 4 mm, at least 5 mm, or at least 10 mm. As yet another additional example, the defined change in the length dimension across one or more of the transition portions 106*a*, 106*b* may be no more than about 15 mm, or no more than about 10 mm, no more than about 8 mm, or no more than about 6 mm, or no more than about 5 mm. In another example, the defined change in length dimension across one or more of the transition portions 106*a*, 106*b* may be no more than 15 mm, no more than 10 mm, no more than 8 mm, no more than 6 mm, or no more than 5 mm.

In some embodiments, the change in the width $W_3$ dimension across one or more of the transition portions 106*a*, 106*b* may be described as a percent change per unit length. The unit length may be at least about 1 mm, or at least about 2 mm, or at least about 3 mm, or at least about 4 mm, or at least about 5 mm, or at least about 6 mm, or at least about 7 mm, or at least about 8 mm, or at least about 9 mm, or at least about 10 mm. Alternatively, the unit length may be at least 1 mm, or at least about 2 mm, or at least about 3 mm, or at least about 4 mm, or at least about 5 mm, or at least about 6 mm, or at least about 7 mm, or at least about 8 mm, or at least about 9 mm, or at least about 10 mm. In such embodiments, the change in the width $W_3$ dimension may be at least about 5% per unit length, or at least about 10% per unit length, at least about 15%, or at least about 20% per unit length, or at least about 25% per unit length, or at least about 30% per unit length. As an additional example, the defined change in the width $W_3$ dimension may be at least 5% per unit length, or at least 10% per unit length, or at least 15%, or at least 20% per unit length, or at least 25% per unit length, or at least 30% per unit length.

In addition, the absolute change in the third width $W_3$ dimension of one or more of the transition portions 106*a*, 106*b* may be from about 0 cm to about 10 cm. For example, the absolute change of the third width $W_3$ dimension may be at least about 1 cm, or at least about 2 cm, or at least about 3 cm, or at least about 4 cm, or at least about 5 cm, or at least about 10 cm. As an additional example, the absolute change of the third width $W_3$ dimension may be at least 1 cm, at least 2 cm, or at least 3 cm, or at least 4 cm, or at least 5 cm, or at least 10 cm. In other embodiments, the absolute change of the third width $W_3$ dimension may be greater than about 10 cm. For example, the absolute change of the third width $W_3$ may be greater than 10 cm.

The width dimension of one or more of the transition portions 106*a*, 106*b* may vary at a constant rate or a non-constant rate as one or more of the transition portions 106*a*, 106*b* extend from the first portion 104 to the second portion 108. For example, if the first width $W_1$ dimension is less than the second width $W_2$ dimension, the third width $W_3$ dimension may increase at a constant rate (or substantially constant rate) as one or more of the transition portions 106*a*, 106*b* extend outwardly from the first portion 104 to the second portion 108. As an additional example, the third width $W_3$ dimension may increase at a first constant rate adjacent the side 114 and may then increase at a second constant rate adjacent the side 116. Edges 118 of one or more of the transition portions 106*a*, 106*b* may be linear or curved because the rate at which the third portion changes is not particularly limited.

Further, a maximum width dimension and a minimum width dimension of one or more of the transition portions 106*a*, 106*b* (e.g., the fourth width $W_{3a}$ dimension and the fifth width $W_{3b}$ dimension) may or may not be bounded by the values of the first width $W_1$ dimension and second width $W_2$ dimension. For example, one or more of the transition portions 106*a*, 106*b* may have a maximum width dimension not greater than about the second width $W_2$ dimension and/or a minimum width dimension not less than about the first width $W_1$ dimension. Alternatively, one or more of the transition portions 106*a*, 106*b* may have a maximum width dimension greater than about the second width $W_2$ dimension and/or a minimum width dimension less than about the first width $W_1$ dimension.

In addition, one or more of the transition portions 106*a*, 106*b* may be tapered along a top edge 120 and/or a bottom edge 122. For example, as illustrated in FIG. 1, both the top edge 120 and the bottom edge 122 are tapered as the transition portion 106*b* extends from the second portion 108 to the first portion 104. As an additional example, only the top edge 120 of the transition portion 106*b* may be tapered, and the bottom edge 122 may be substantially parallel to a bottom edge 124 of the first portion 104 and a bottom edge 126 of the second portion 108.

In a preferred embodiment, a length $L_3$ of the second portion 108 may be greater than both a length $L_1$ of the first portion 104 and a collective length $L_2$ of the transition portions 106*a*, 106*b* (for ease of comparison, individual lengths of the transition and second portions 106, 108 as illustrated in FIG. 1 have been added together in this analysis). For example, when comparing the lengths $L_1$, $L_2$, and $L_3$ of the portions 104, 106, 108, the lengths may have a ratio of about 1:1:4, respectively. In other embodiments, the ratio of the lengths $L_1$, $L_2$, and $L_3$ may be about 1:1:3, or about 1:1:5, or about 1:1:6, or about 1:1:7, or about 1.5:1:3, or about 1.5:1:4, or about 1.5:1:5, or about 1.5:1:6, or about 1.5:1:7, or about 2:1:4, or about 2:1:5, or about 2:1:6, or about 2:1:7. As an additional example, the lengths $L_1$, $L_2$, and $L_3$ of the portions 104, 106, 108, the lengths may have a ratio of 1:1:4, respectively. In other embodiments, the ratio of the lengths $L_1$, L 2, and $L_3$ may be 1:1:3, or 1:1:5, or 1:1:6, or 1:1:7, or 1.5:1:3, or 1.5:1:4, or 1.5:1:5, or 1.5:1:6, or 1.5:1:7, or 2:1:4, or 2:1:5, or 2:1:6, or 2:1:7.

In some embodiments, the length $L_1$ dimension of the first portion 104 may be less than about 50% of the length $L_3$ dimension of the second portion 108, less than about 40% of the length $L_3$ dimension of the second portion 108, less than about 30% of the length $L_3$ dimension of the second portion 108, or less than about 20% of the length $L_3$ dimension of the second portion 108. As an additional example, the length $L_1$ dimension of the first portion 104 may be less than 50% of the length $L_3$ dimension of the second portion 108, less than 40% of the length $L_3$ dimension of the second portion 108, less than 30% of the length $L_3$ dimension of the second portion 108, or less than 20% of the length $L_3$ dimension of the second portion 108.

In some embodiments, the length $L_3$ dimension of the second portion 108 may be at least about 50% greater than the length $L_1$, $L_2$ dimensions of the transition portions 106*a*, 106*b* and/or the first portion 104, or may be at least about 60% greater than the length $L_1$, $L_2$ dimensions of the transition portions 106*a*, 106*b* and/or the first portion 104, or may be at least about 70% greater than the length $L_1$, $L_2$ dimensions of the transition portions 106*a*, 106*b* and/or the first portion 104, or may be at least about 80% greater than the length $L_1$, $L_2$ dimensions of the transition portions 106*a*, 106*b* and/or the first portion 104, or may be at least about 90% greater than the length $L_1$, $L_2$ dimensions of the transition portions 106*a*, 106*b* and/or the first portion 104, or may be at least about 100% greater than the length $L_1$, $L_2$ dimensions of the transition portions 106*a*, 106*b* and/or the first portion 104, or may be at least about 125% greater than the length $L_1$, $L_2$ dimensions of the transition portions 106*a*, 106*b* and/or the first portion 104, or may be at least about 150% greater than the length $L_1$, $L_2$ dimensions of the transition portions 106*a*, 106*b* and/or the first portion 104, or may be at least about 175% greater than the length $L_1$, $L_2$ dimensions of the transition portions 106*a*, 106*b* and/or the first portion 104, or may be at least about 200% greater than the length $L_1$, $L_2$ dimensions of the transition portions 106*a*, 106*b* and/or the first portion 104, or may be at least about 225% greater than the length $L_1$, $L_2$ dimensions of the transition portions 106*a*, 106*b* and/or the first portion 104, or may be at least about 250% greater than the length $L_1$, $L_2$ dimensions of the transition portions 106*a*, 106*b* and/or the first portion 104, or may be at least about 275% greater than the length $L_1$, $L_2$ dimensions of the transition portions 106*a*, 106*b* and/or the first portion 104, or may be at least about 300% greater than the length $L_1$, $L_2$ dimensions of the transition portions 106*a*, 106*b* and/or the first portion 104, or may be at least about 400% greater than the length $L_1$, $L_2$ dimensions of the transition portions 106*a*, 106*b* and/or the first portion 104. As an additional example, the length $L_3$ dimension of the second portion 108 may be at least 50% greater than the length $L_1$, $L_2$ dimensions of the transition portions 106*a*, 106*b* and/or the first portion 104, or may be at least 60% greater than the length $L_1$, $L_2$ dimensions of the transition portions 106*a*, 106*b* and/or the first portion 104, or may be at least 70% greater than the length $L_1$, $L_2$ dimensions of the transition portions 106*a*, 106*b* and/or the first portion 104, or may be at least 80% greater than the length $L_1$, $L_2$ dimensions of the transition portions 106*a*, 106*b* and/or the first portion 104, or may be at least 90% greater than the length $L_1$, $L_2$ dimensions of the transition portions 106*a*, 106*b* and/or the first portion 104, or may be at least 100% greater than the length $L_1$, $L_2$ dimensions of the transition portions 106*a*, 106*b* and/or the first portion 104, or may be at least 125% greater than the length $L_1$, $L_2$ dimensions of the transition portions 106*a*, 106*b* and/or the first portion 104, or may be at least 150% greater than the length $L_1$, $L_2$ dimensions of the transition portions 106*a*, 106*b* and/or the first portion 104, or may be at least 175% greater than the length $L_1$, $L_2$ dimensions of the transition portions 106*a*, 106*b* and/or the first portion 104, or may be at least 200% greater than the length $L_1$, $L_2$ dimensions of the transition portions 106*a*, 106*b* and/or the first portion 104, or may be at least 225% greater than the length $L_1$, $L_2$ dimensions of the transition portions 106*a*, 106*b* and/or the first portion 104, or may be at least 250% greater than the length $L_1$, $L_2$ dimensions of the transition portions 106*a*, 106*b* and/or the first portion 104, or may be at least 275% greater than the length $L_1$, $L_2$ dimensions of the transition portions 106*a*, 106*b* and/or the first portion 104, or may be at least 300% greater than the length $L_1$, $L_2$ dimensions of the transition portions 106*a*, 106*b* and/or the first portion 104, or may be at least 400% greater than the length $L_1$, $L_2$ dimensions of the transition portions 106*a*, 106*b* and/or the first portion 104.

In other embodiments, the length $L_1$ dimension of the first portion 104 and the length $L_3$ dimension of one or more of the transition portions 106*a*, 106*b* may remain substantially constant even as an overall length or circumference of the waistband 100 increases. For example, the waistband 100 may be included in garments of various sizes (e.g., small, medium, large, extra-large, etc.), which may necessitate greater or lesser overall lengths for the waistband 100. In such embodiments, a ratio of the length $L_3$ dimension of the transition portions 106 to the length $L_1$ dimension of the first portion 104 may be at least about 1:1, or at least about 1:1.5, or at least about 1:2. Further, a ratio of the length $L_3$ dimension of the transition portions 106 compared to the length $L_1$, $L_3$ dimensions of the portions 104, 108 in such embodiments may be about 1:1:6 to about 1:1:8, or about 1:1:6 to about 1:1:7, or about 1:1.5:6 to about 1:1.5:8, or about 1:1.5:6 to about 1:1.5:7, or about 1:2:6 to about 1:2:8, or about 1:2:6 to about 1:2:7. As an additional example, a ratio of the length $L_3$ dimensions of the transition portions 106 to the length $L_1$ dimension of the first portion 104 may be at least 1:1, or at least 1:1.5, or at least 1:2. Further, a ratio of the length $L_3$ dimension of the transition portions 106 compared to the lengths $L_1$, $L_3$ of the portions 104, 108 in such embodiments may be 1:1:6 to 1:1:8, or 1:1:6 to 1:1:7, or 1:1.5:6 to 1:1.5:8, or 1:1.5:6 to 1:1.5:7, or 1:2:6 to 1:2:8, or 1:2:6 to 1:2:7.

In alternative embodiments, the length $L_3$ dimension of the second portion 108 may be about the length $L_1$ dimension of the first portion 104 and/or the length $L_2$ dimension of one or more of the transition portions 106*a*, 106*b*. In other embodiments, the length $L_3$ dimension of the second portion 108 may be less than the length $L_1$ dimension of the first portion 104 and/or the length $L_2$ dimensions of one or more of the transition portions 106*a*, 106*b*.

The first end 110 and the second end 112 of the waistband 100 may be provided on opposite ends of the flexible body 102 (in an open configuration). The first and second ends 110, 112 may be provided as a part of the second portion 108, although in alternative embodiments the first and second ends 110, 112 may be provided on the first portion 104 and/or the transition portions 106 of the body. Generally, the first and second ends 110, 112 may be coupled together, as illustrated in FIG. 2, to provide the waistband 100 in a closed configuration.

Figure 2:
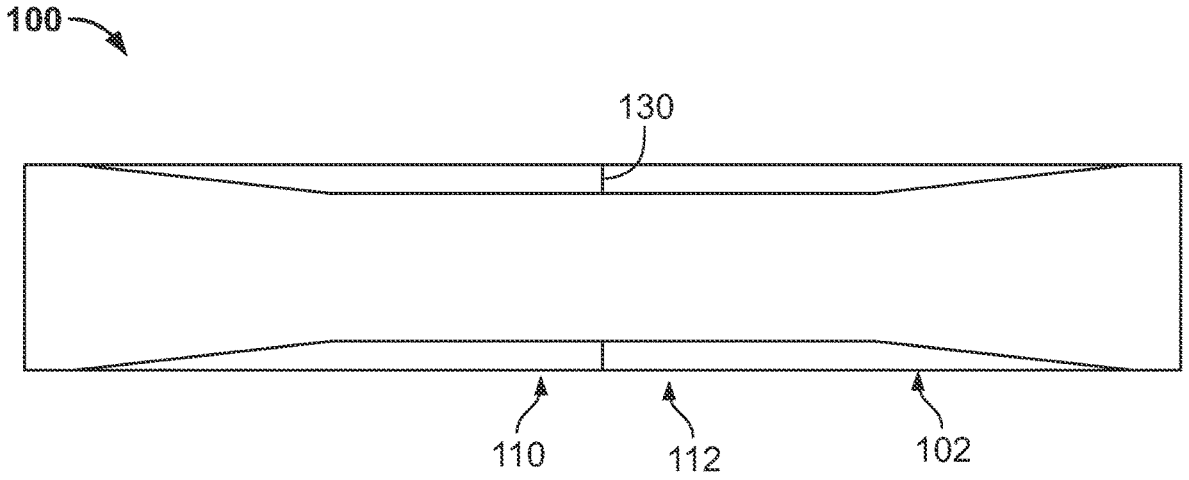
FIG. 2 is a front elevational view of the waistband of FIG. 1 in a closed configuration.
Figure 3:
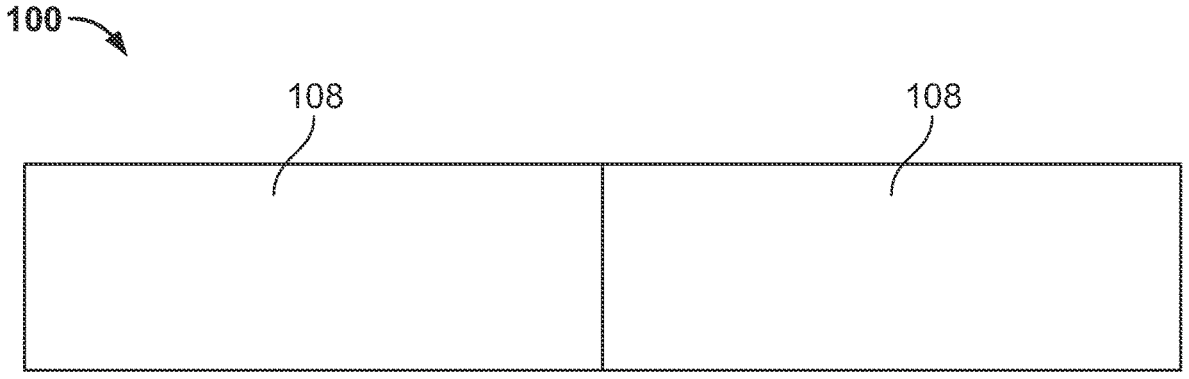
FIG. 3 is a rear elevational view of the waistband of FIG. 2.
Figure 4:
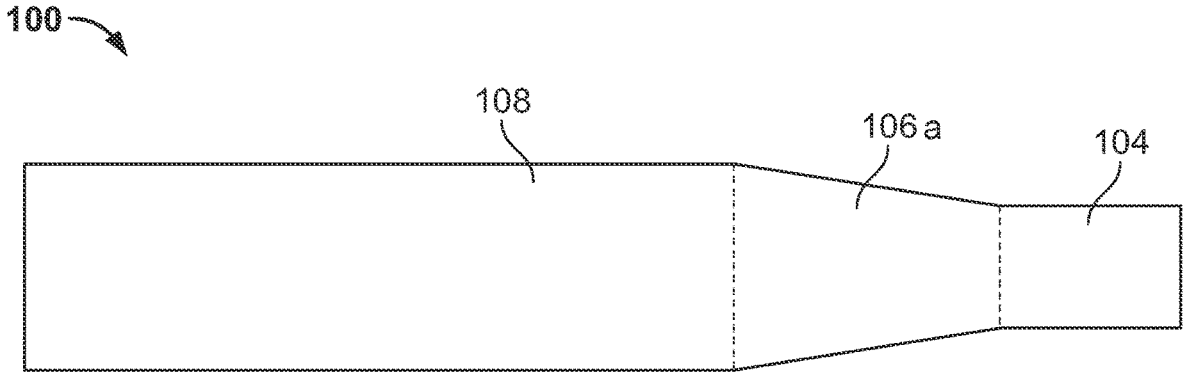
FIG. 4 is a left side elevational view of the waistband of FIG. 2.
Figure 5:
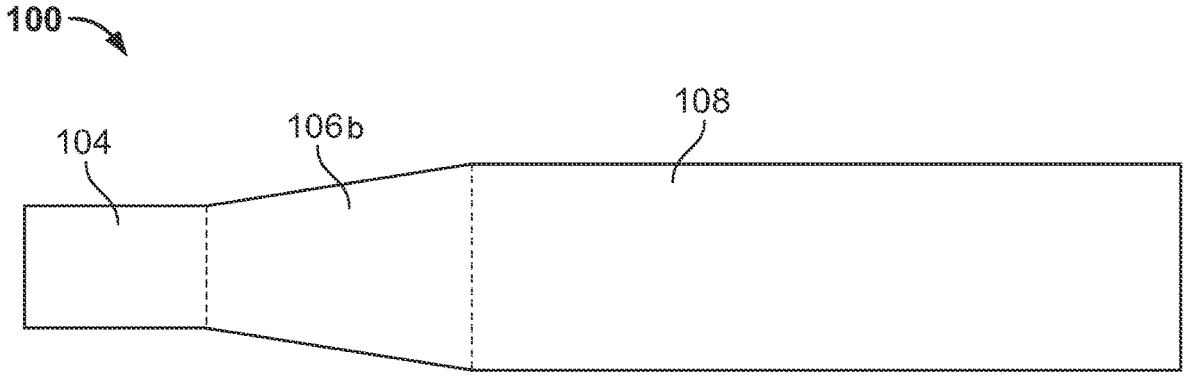
FIG. 5 is a right side elevational view of the waistband of FIG. 2.

The attachment mechanism 130 may be provided such that the first and second ends 110, 112 of the flexible body 102 may be coupled to each other, as depicted in FIG. 2. The attachment mechanism 130 may be provided as a seam in the flexible body 102 when the waistband 100 is in the closed configuration. In some embodiments, if the attachment mechanism 130 is provided as a seam, the seam may comprise a flatseam. Further, the seam may comprise soft-touch or soft-feel threads (e.g., texturized threads and/or threads treated with a silicone-based coating). In alternative embodiments, the attachment mechanism 130 may be provided as an adhesive, a bonding strip, threads, or other such mechanisms known in the art. It should be noted that the waistband 100 is depicted as being joined at the first and second ends 110, 112, however, the seam, intersection, or attachment mechanism 130 where the waistband 100 is joined or closed, may be provided at any other point or section circumscribing the waistband 100. As a result, the second portion may be provided in the form of a substantially continuous and uniform section (e.g., does not include the point of attachment).

In some embodiments, the waistband 100 may be provided as a seamless waistband that is knit in the round. In such embodiments, the attachment mechanism 130 may be unnecessary and may not be provided with the waistband 100. Generally, the teachings described above for the waistband 100 also apply to a waistband 100 knit in the round.

FIGS. 3-7 illustrate additional views of the waistband 100 in the closed configuration. Although the waistband 100 is illustrated in a substantially symmetrical form wherein the right and left sides of the waistband 100 substantially mirror each other, the waistband 100 need not be provided wherein the waistband 100 has such a general symmetry. Further, because of the flexible properties of the flexible body 102, the waistband can assume a variety of shapes, including an oval (see FIGS. 6 and 7), as would be used within a garment.

Figure 6:
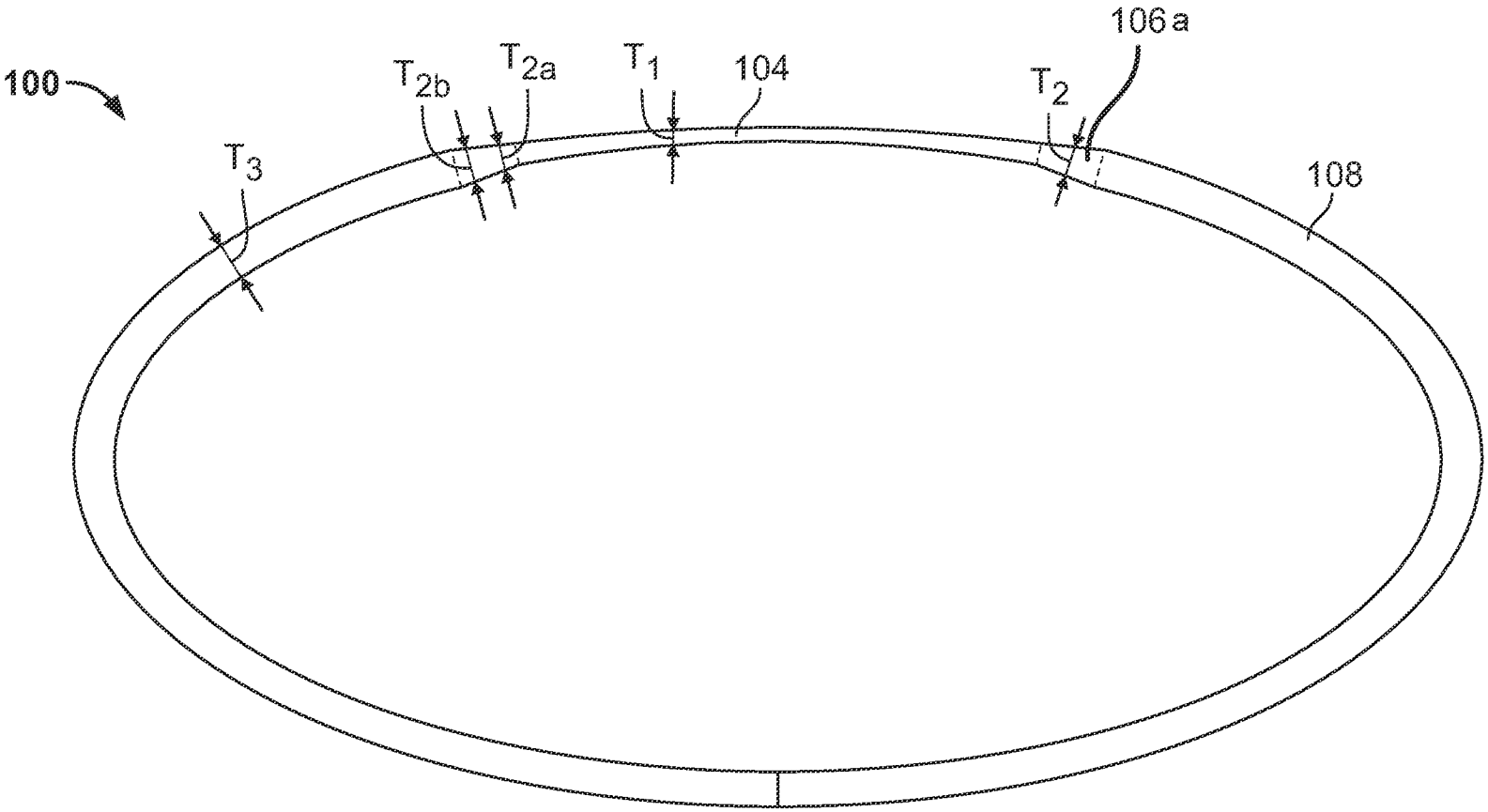
FIG. 6 is a top plan view of the waistband of FIG. 2.
Figure 7:
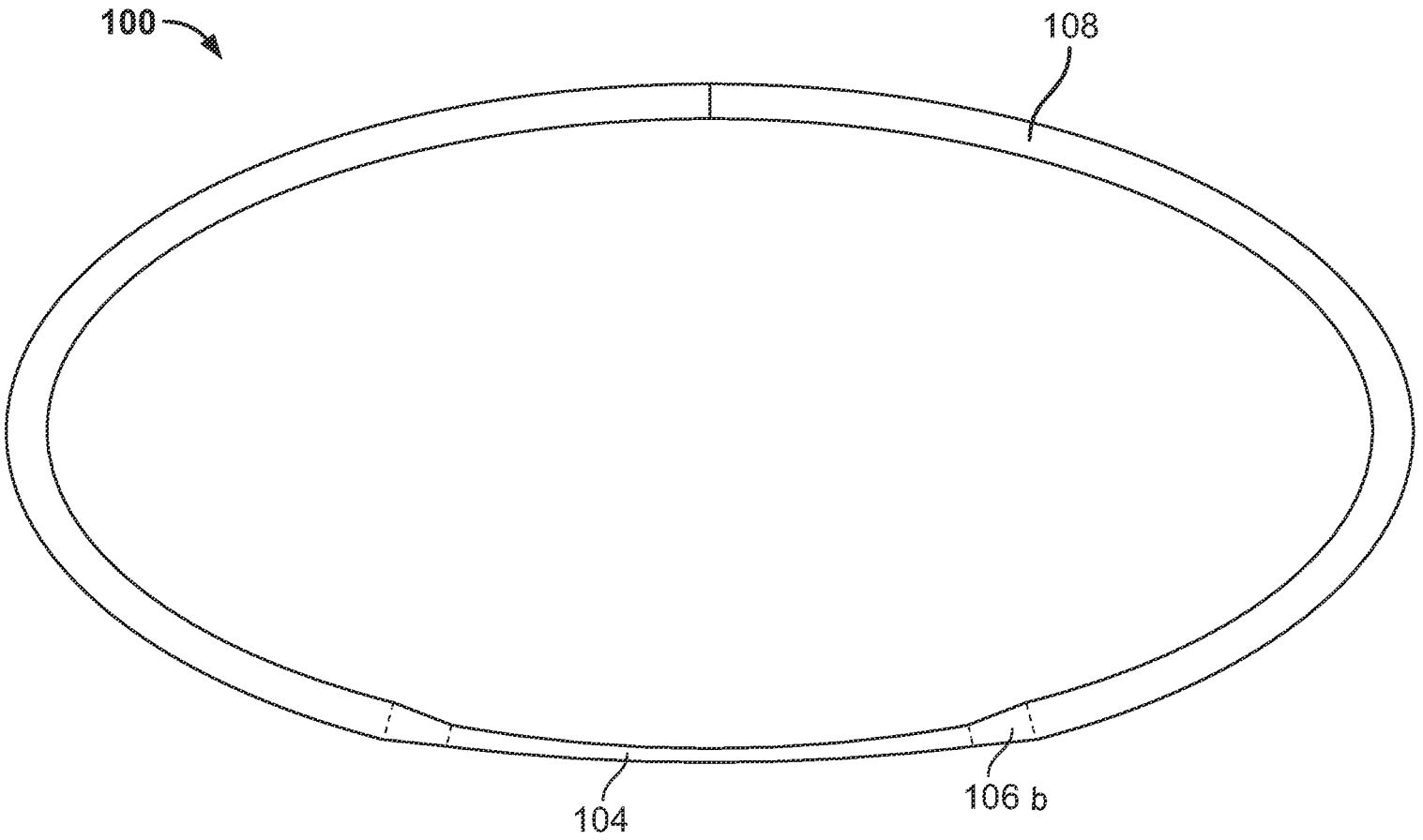
FIG. 7 is a bottom plan view of the waistband of FIG. 2.

As shown in FIGS. 6 and 7, in some embodiments, one or more portions 104, 106, 108 of the waistband 100 may be imparted with different thicknesses, or each portion of the waistband 100 may be imparted with the same thickness. More specifically, a first thickness $T_1$ dimension of the first portion 104, a second thickness $T_2$ dimension of one or more of the transition portions 106, and/or a third thickness $T_3$ dimension of the second portion 108 may be substantially the same value, or the thickness $T_1$, $T_2$, and/or $T_3$ dimensions may be different values with respect to each other. For example, the first thickness $T_1$ dimension may be about equal to, equal to, or less than the second thickness $T_2$ dimension, and the second thickness $T_2$ dimension may be about equal to, equal to, or less than the third thickness $T_3$ dimension. As an additional example, the first thickness $T_1$ dimension may be less than the second thickness $T_2$ dimension, and the second thickness $T_2$ dimension may be less than the third thickness $T_3$ dimension. Alternatively, the first thickness $T_1$ dimension and the second thickness $T_2$ dimensions may be about equal to, or equal to, each other, while the third thickness $T_3$ dimension may be greater than each of the thickness $T_1$, $T_2$ dimensions. For example, the first thickness $T_1$ dimension and the second thickness $T_2$ dimension may be about equal to, or equal to, each other, while the third thickness $T_3$ dimension may be greater than the thickness $T_1$, $T_2$ dimensions. Further, the first thickness $T_1$ dimension may be about equal to, equal to, or greater than the second thickness $T_2$ and/or the third thickness $T_3$. For example, the first thickness $T_1$ dimension may be greater than the second thickness $T_2$ dimension and/or the third thickness $T_3$ dimension.

In some embodiments, one or more of the transition portions 106*a*, 106*b* may have a fourth thickness $T_2$ a dimension and a fifth thickness $T_{2b}$ dimension. The fourth thickness $T_2$ a dimension may be about equal, or equal to the thickness $T_1$ dimension of the first portion 104 and the fifth thickness $T_{2b}$ dimension may be about equal, or equal to the third thickness $T_3$. For example, the fourth thickness $T_2$ a dimension may have the same value as the thickness $T_1$ dimension of the first portion 104 and the fifth thickness $T_{2b}$ dimension may have the same value as the third thickness $T_3$ dimension. Thus, the fourth thickness $T_2$ a dimension and the fifth thickness $T_{2b}$ dimension of one or more of the transition portions 106*a*, 106*b* may represent the approximate minimum and maximum values of the thickness $T_2$ dimension of the transition portions 106*a*, 106*b*. Generally, the thickness $T_2$ dimension of one or more of the transition portions 106*a*, 106*b* may increase from the fourth thickness $T_2$ a dimension to the fifth thickness $T_{2b}$ dimension. The rate of increase of the second thickness $T_{2b}$ dimension between the fourth thickness $T_{2a}$ dimension and the fifth thickness $T_{2b}$ dimension may be gradual, rapid, continuous, and/or discontinuous. For example, the fourth thickness $T_{2a}$ dimension may increase by 1 mm per a defined unit length across one or more of the transition portions 106*a*, 106*b* until achieving the value of the fifth thickness $T_{2b}$ dimension. In some embodiments, the thickness $T_2$ of the transition portion 106 may increase from about 0 mm to about 10 mm until achieving the value of the fifth thickness $T_{2b}$. As an additional example, the thickness $T_2$ of the transition portion 106 may increase from 0 mm to 10 mm until achieving the value of the fifth thickness $T_{2b}$. In other embodiments, the thickness $T_2$ of the transition portion 106 may increase by a value of more than 10 mm until achieving the value of the fifth thickness $T_{2b}$.

Figure 8:
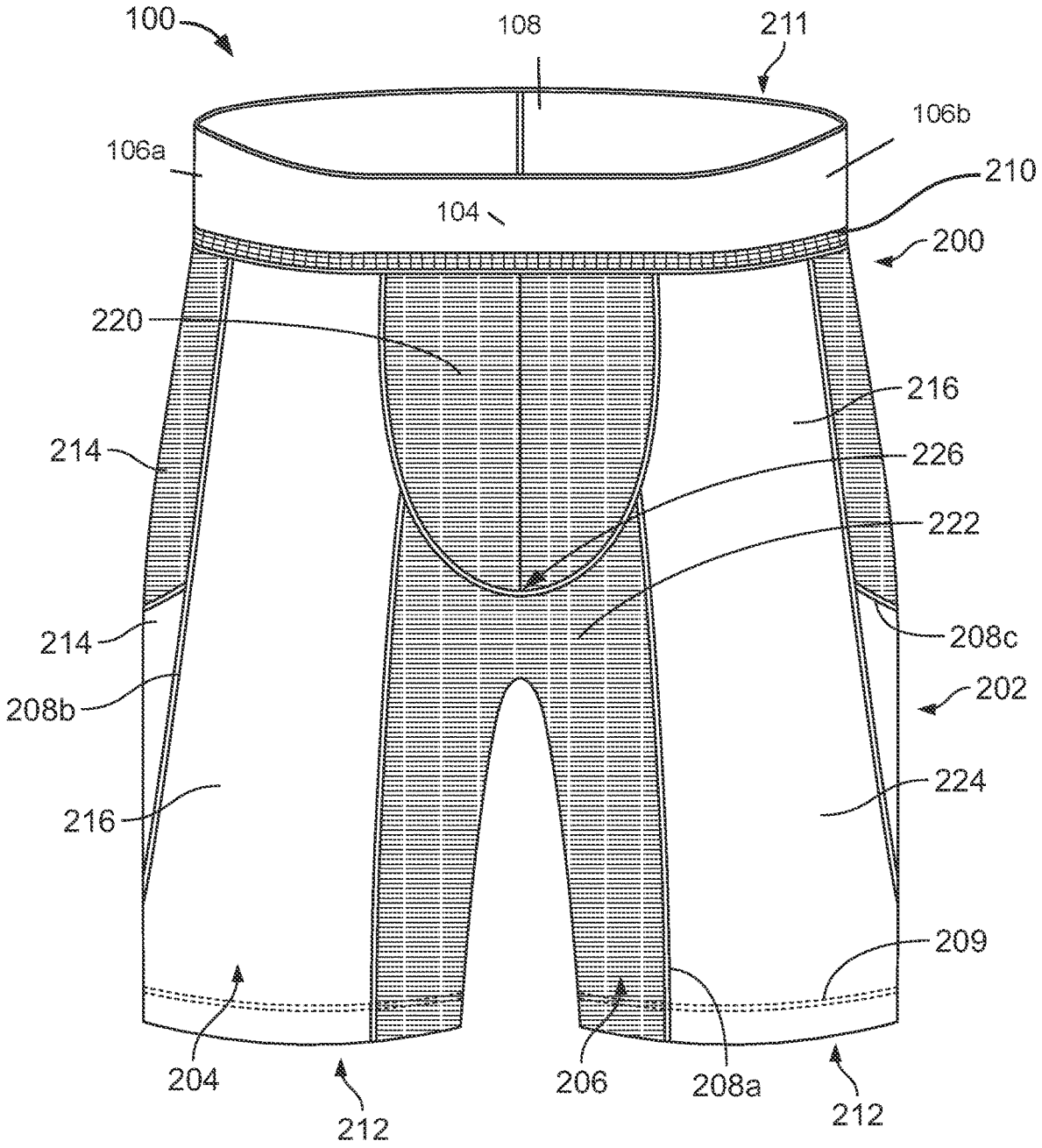
FIG. 8 is a front elevational view of a performance undergarment including the waistband of FIG. 1, the performance undergarment constructed according to the teachings herein.

Turning to FIG. 8, an exemplary undergarment 200 incorporating the waistband 100 is provided. Although the undergarment 200 is illustrated in the form of a boxer brief, the form of the undergarment 200 is not so limited. For example, the undergarment 200 may be provided as a boxer, a brief, a bikini short, a high-waisted short, a low-waisted short, a thong, a panty, a compression short, and the like. Further, the undergarment 200 may be provided as a lower body garment, or coupled to a lower portion of an upper body garment (e.g., a shirt, a sweatshirt, and the like). Alternatively, the undergarment 200 may be provided within, or coupled to, another lower body garment (e.g., a short, a pant, sweatpants, and the like).

The undergarment 200 may be provided in the form of a body 202 having at least a first zone 204 and a second zone 206. Portions of the first zone 204 and the second zone 206 may be coupled or joined by one or more seams 208. The undergarment 200 may further include legbands 209 and a waistband seam 210 (for coupling the waistband 100 to the body 202). Although the undergarment 200 is depicted as having the waistband 100 depicted in FIGS. 1-7, the undergarment 200 may be provided with another type of waistband (not shown) that does not include a tapered portion and/or portion having a smaller width (e.g., is provided in a substantially uniform width around the entire circumference thereof).

After the undergarment 200 is constructed, the body 202 may generally be provided with a waist opening 211 and leg openings 212. The waist opening 211 and the leg openings 212 may be positioned at opposite ends of the undergarment 200 (e.g., at a first end and a second end of the undergarment 200). The fabric comprising the body 202 may be provided between the waist opening 211 and the leg openings 212. The waistband 100 may define and/or be substantially equal to, or equal to, the circumference of the waist opening 211.

More particularly, the body 202 of the undergarment 200 may be constructed of various sections including (but not limited to) upper and lower side sections 214, front sections 216, back sections 218 (see FIG. 9), a pouch 220, and interior sections 222. Each of the sections 214, 216, 218, 220, 222 may be provided as a single panel, or each of the sections 214, 216, 218, 220, 222 may be provided in the form of multiple panels. Further, each of the sections 214, 216, 218, 220, 222, and/or the individual panels comprising the sections 214, 216, 218, 220, 222 may be coupled via one or more seams 208, bonding, or other joining mechanisms. For example, the pouch 220, the internal sections 222, and the front sections 216 may be coupled via the seam 208*a*, the front, back, and side sections 214, 216, 218 may be coupled via the seam 208*b* (see also FIG. 9), and the individual panels of the side sections 214 may be coupled via the seam 208*c*. In each case, the seams 208 may be broken into smaller, individual seams that are coupled to each other, or as a single continuous seam. Furthermore, fewer or additional seams 208 than those illustrated may be used to construct the undergarment 200.

The sections 214, 216, 218, 220, 222 may be designed to overlie a particular portion of the wearer's body when the undergarment is worn. For example, the side sections 214 may overlie an outer side region of the wearer's thighs, the front sections 216 may overlie a front region of the wearer's thighs and a portion of the wearer's genital area, the back sections 218 may overlie the wearer's buttocks, the pouch 220 may overlie or retain the wearer's genitals, and the internal sections 222 may overlie at least a portion of the wearer's internal thigh region.

In some embodiments, the seams 208, 210 may be provided in the form of a flatseam. In other embodiments, the seams 208, 210 may be provided as an overedge seam, a break-open covered seam, a fold-over seam, and the like. In addition, the threads comprising the seams 208, 210 may comprise a soft-touch or soft-feel thread. Alternatively, the seams 208, 210 may not be provided; rather an adhesive, a bonding strip, or other similar mechanisms may be used to couple the waistband 100 and/or one or more of the sections 214, 216, 218, 220, 222 together.

The first zone 204 of the undergarment 200 may be a portion of the body 202 imparted with a first coefficient of friction. As such, the first zone 204 may comprise at least a portion of the body 202. The first zone 204 may be contiguous or may be provided as separate sections of the undergarment 200. In a preferred embodiment, the front sections 216, at least a portion of the side sections 214, and the back sections 218 may comprise the first zone 204. In alternative embodiments, the first zone 204 may be comprised of substantially all or a portion of the sections 214, 216, 218, 220, 222.

The second zone 206 of the undergarment 200 may be defined as a portion of the body 202 imparted with a second coefficient of friction that is different from the first coefficient of friction. As such, the second zone 206 may comprise at least a portion of the body 202. The second zone 206 may be contiguous or may be provided as separate sections of the undergarment 200. In a preferred embodiment, the pouch 220, the internal sections 222, and at least a portion of the side sections 214 may comprise the second zone 206. In alternative embodiments, the second zone 206 may be comprised of substantially all or a portion of the sections 214, 216, 218, 220, 222.

In one aspect, the zones 204, 206 may be defined by the fabrics or materials used to create portions of the body 202, the fabrics or materials imparted with different coefficients of friction. For example, the first zone 204 may comprise a first fabric, while the second zone 206 may comprise a second, different fabric. The materials comprising the first and second fabrics are not particularly limited and may include one or more of nylon, viscose or rayon, cotton, spandex, or combinations thereof. The second fabric may be imparted with the second coefficient of friction that defines the second zone 206, while the first fabric may be imparted with the first coefficient of friction that defines the first zone 204. The first and second fabrics may further be distinguishable based on the materials comprising the fabrics, the mechanical construction of the fabrics, and/or by a chemical treatment or coating (or lack thereof) applied to the fabrics. For example, the first fabric may comprise a jersey fabric while the second fabric may comprise a mesh fabric. As an additional example, the first fabric may be provided as a nylon-spandex mixture in the form of a jersey fabric, while the second fabric may be provided as a nylon-spandex mixture in the form of a mesh fabric. As yet another example, the first fabric may be provided as a micro-nylon and spandex mixture in the form of a jersey fabric, while the second fabric may be provided as a nylon-spandex mixture in the form of a mesh fabric. As an additional example, the second fabric may have a topical, anti-friction coating applied to at least one face of the fabric, while the first fabric may lack such a topical treatment, or may include a different topical treatment.

In a preferred embodiment, no matter the composition of the first and second fabrics, the second coefficient of friction of the second zone 206 is less than the first coefficient of friction of the first zone 204. Thus, the second zone 206 of the undergarment 200 may be functionally defined by its anti-chafing properties, which in turn may provide an undergarment 200 that is more comfortable for the wearer.

In addition to the topical coatings described above, the first zone 204, the second zone 206, and/or the waistband 100 may be treated with a topical agent to enhance various performance characteristics of the undergarment 200. For example, a topical finish may be applied to at least one face of the first zone 204, second zone 206, and/or the waistband 100 to provide one or more fabric properties including, for example, temperature regulation, UV protection, moisture wicking, breathability, and/or antimicrobial properties to the aforementioned portions of the undergarment 200. Furthermore, the first zone 204, the second zone 206, and/or the waistband 100 may include threads and/or fabrics that impart the undergarment 200 with, by way of example, temperature regulation, UV protection, moisture wicking, breathability, and/or antimicrobial properties. In some instances, the coating may be applied to one or more internal portions (those portions that are designed to contact the wearer's body) of the undergarment 200 and/or waistband 100.

Referring again to FIG. 8, the bands 209 are coupled to legs 224 (e.g., one band is coupled to each of the legs) of the undergarment 200 and are provided proximate to the leg openings 212. The legs 224 are designed to overlie a portion of and circumscribe the wearer's thighs when the undergarment 200 is worn. As such, the bands 209 may also overlay and circumscribe a portion of the wearer's thighs. The bands 209 may extend through the body 202 of the undergarment 200 such that the bands 209 are visible on both a wearer-facing side and an outer-facing side of the undergarment 200. The bands 209 may be provided as a seam (similar to the seam 208), a sewn hem, a bonded adhesive hem, a laser cut edge, and/or the bands 209 may include an elastic band designed to hold the legs 224 of the undergarment 200 in position on the wearer's body. For example, if provided in the form of an elastic band, the bands 209 may help ensure that the undergarment 200 substantially remains in the position selected by the wearer when the wearer is satisfied with the position of the undergarment 200 on his or her body until the undergarment 200 is removed from the body or repositioned. Furthermore, in some embodiments, the bands 209 may also include a silicone material or a printed material applied to the wearer-facing side of the bands 209 to further help prevent ride up on the wearer's body.

In embodiments of the undergarment wherein legs 224 are not provided (e.g. if the undergarment 200 is provided in the form of a brief or panty), the bands 209 may be provided adjacent to the leg openings 212 or omitted all together. In some instances, the bands 209 may be omitted from the undergarment 200.

The waistband seam 210 may couple or join the waistband 100 to the undergarment 200. The waistband seam 210 may be provided around the entire circumference defined by the waist opening 211 and/or the body 202, or the waistband seam 210 may be provided around a portion of the circumference. In some embodiments, the waistband seam 210 may be omitted, and the waistband 100 may be coupled to the undergarment 200 via an adhesive, a bonding strip, or the like.

Portions of the body 202 may also be coupled to the waistband seam 210 such that the undergarment 200 is provided as one continuous piece. For example, any of the sections 214, 216, 218, 220, may be coupled to the waistband seam 210. As such, any of the sections 214, 216, 218, 220 may also be coupled to the waistband 100.

When coupled to the undergarment 200, the waistband 100 may be arranged such that the portions 104, 106, 108 are adjacent to particular regions of the wearer's body. For example, the waistband 100 may be arranged on the undergarment 200 such that the first portion 104 is adjacent to the wearer's abdomen and the second portion 108 is adjacent to at least the wearer's back, buttocks, and sides. As an additional example, the first portion 104 may be positioned adjacent to the wearer's abdomen, the transition portions 106*a*, 106*b* may be positioned adjacent to the wearer's sides, and the second portion 108 may be positioned adjacent to the wearer's back and buttocks. When arranged in such configurations, the waistband 100 may provide an undergarment that allows the wearer to bend forward more easily, while also supporting the wearer's back and/or side regions and preventing the undergarment 200 from sliding up or down the wearer's body during wear.

Figure 10:
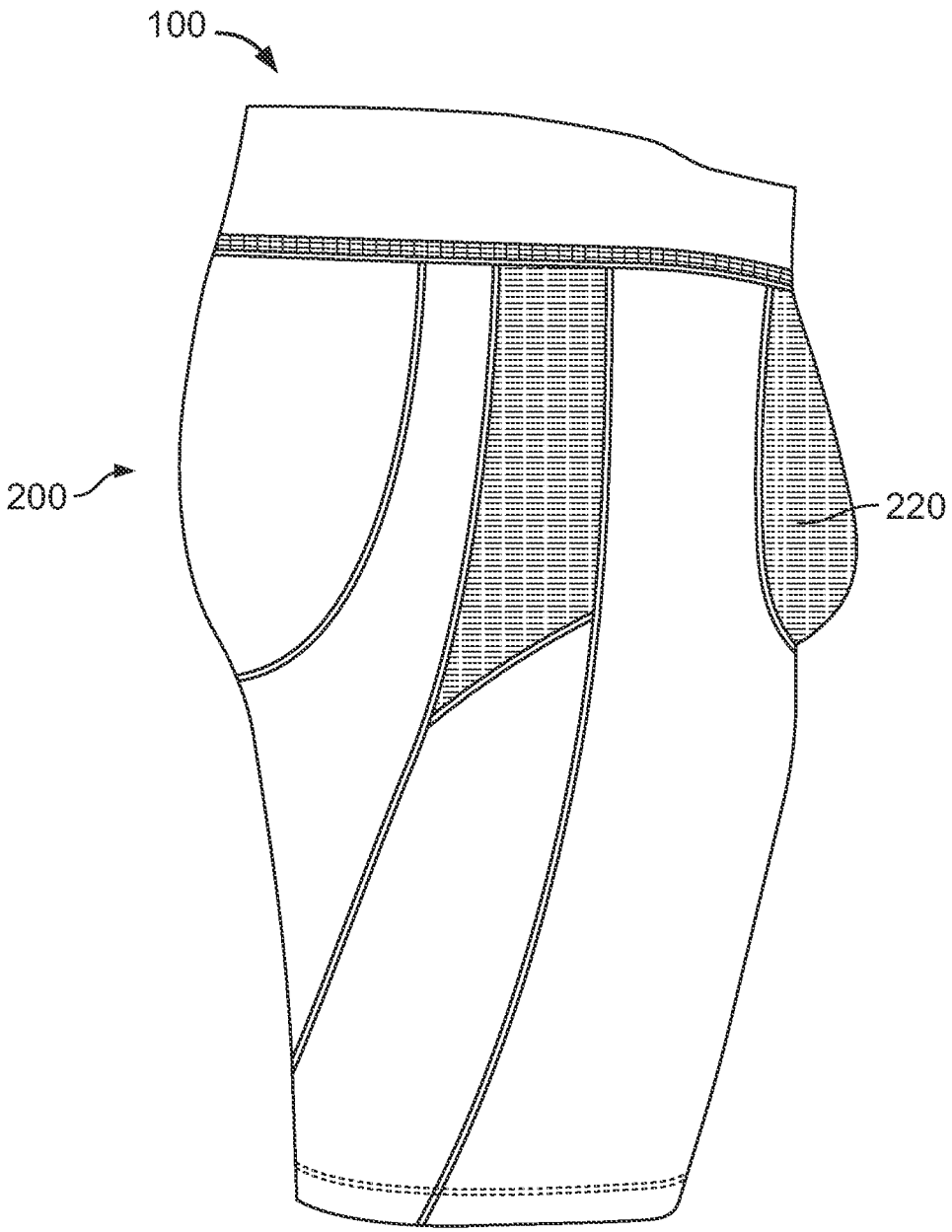
FIG. 10 is a left side elevational view of the performance undergarment of FIG. 8.
Figure 11:
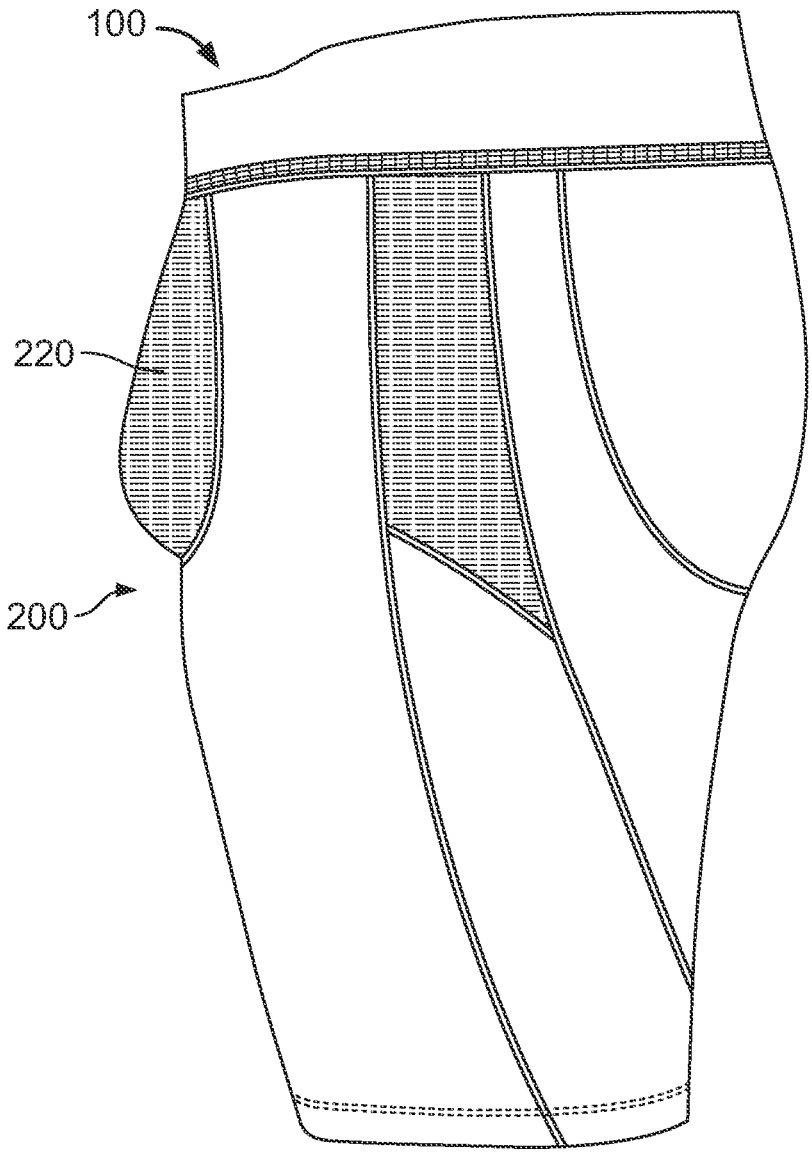
FIG. 11 is a right side elevational view of the performance undergarment of FIG. 8.
Figure 12:
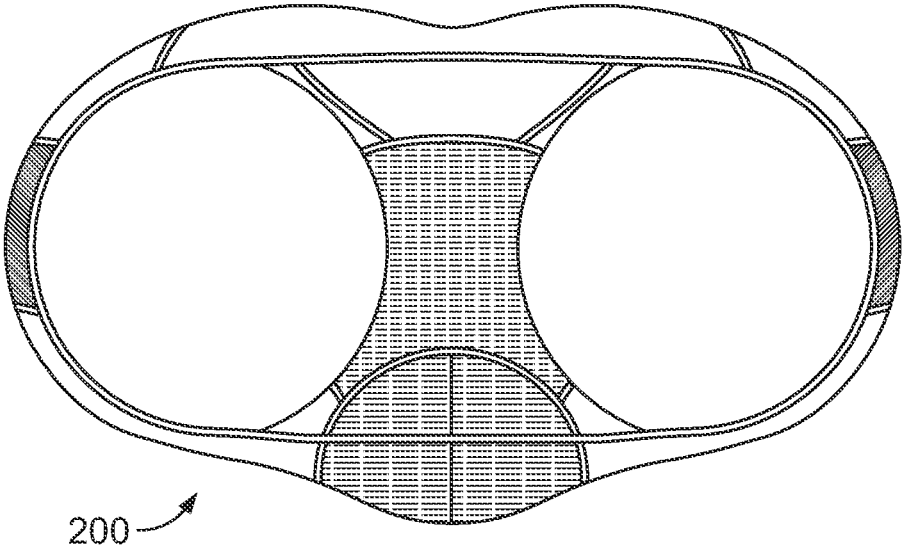
FIG. 12 is a top plan view of the performance undergarment of FIG. 8.
Figure 13:
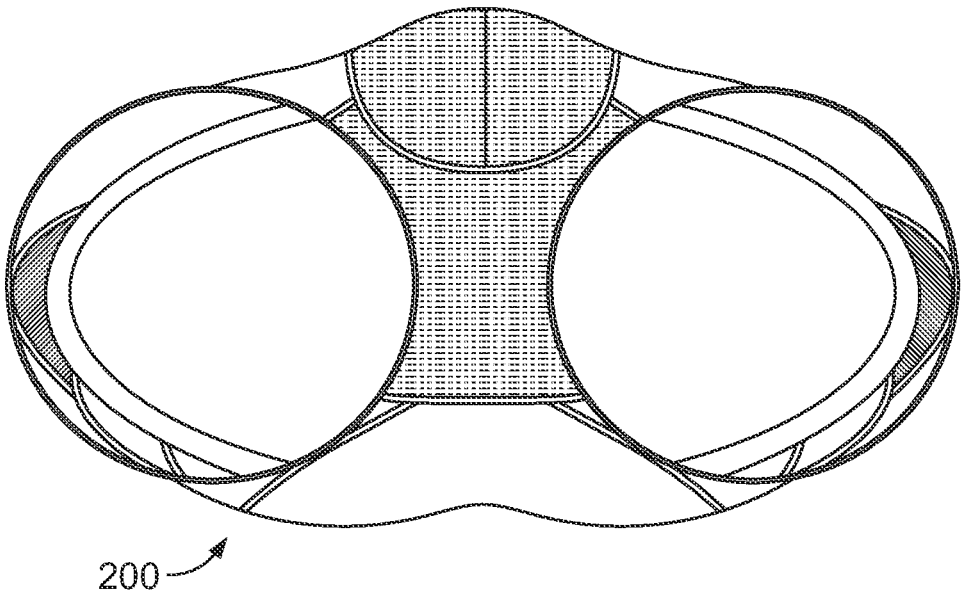
FIG. 13 is a bottom plan view of the performance undergarment of FIG. 8.

The pouch 220 may be defined by the portion of the undergarment 200 that is designed to overlie the genital area of the wearer. Particularly, the pouch 220 may be provided as a three-dimensional structure that is designed to protrude from the body 202 of the undergarment 200 during wear (e.g., see FIGS. 10 and 11). Thus, the pouch 220 may provide an area into which the genitals of the wearer can be received, which in turn may provide a more comfortable fit for the undergarment 200. Furthermore, if the pouch 220 is included in the second zone 206, the pouch 220 may comprise an anti-chafing mesh material that is both breathable and imparted with the second coefficient of friction. When chafing is prevented, the sensitive genital area of the wearer may be protected and may remain comfortable while the undergarment 200 is worn. The pouch 220 may also be provided in the form of the Total Support Pouch® provided by Hanes Brands, Inc. and described in U.S. Pat. No. 10,986,877 and U.S. patent application Ser. Nos. 62,322, 779, 17,238,665, 17,818,698, and 17,818,701, the contents of which are incorporated by reference in their entirety.

Referring still to FIG. 8, the seam 208 coupling the pouch 220, the front sections 216, and the internal sections 222 may further include a rigid seam portion 226. In a preferred embodiment, the rigid seam portion 226 is provided as a curved seam at the bottom of the pouch and comprises a nilo braid. The nilo braid may be provided in the form of a rigid, narrow tape that is enclosed in the rigid seam portion 226. In other embodiments, the rigid seam portion 226 may be provided as a rigid tape similar to the nylon braid, a non-textured thread, a tensioned thread, an adhesive bonding, and the like. Providing the rigid seam portion 226 may help the seam 208 support the bottom of the pouch 220. As such, the nilo braid may help restrict a bouncing, springing, or rebounding type motion in the pouch 220, and thus help prevent the contents of the pouch 220 from being jostled as the wearer of the undergarment 200 moves.

As discussed above, the internal sections 222 may comprise a portion of the second zone 206. Preferably, the internal sections 222 are provided as a gusset. The internal sections 222 may be defined by a portion of the undergarment 200 that overlies an inner thigh region and/or a lower genital region of the wearer. When provided in the second zone 206, the internal sections 222 may protect the wearer's inner thigh region and lower genital area from chafing. If chafing is prevented, the wearer may remain comfortable while the undergarment 200 is worn.

Figure 9:
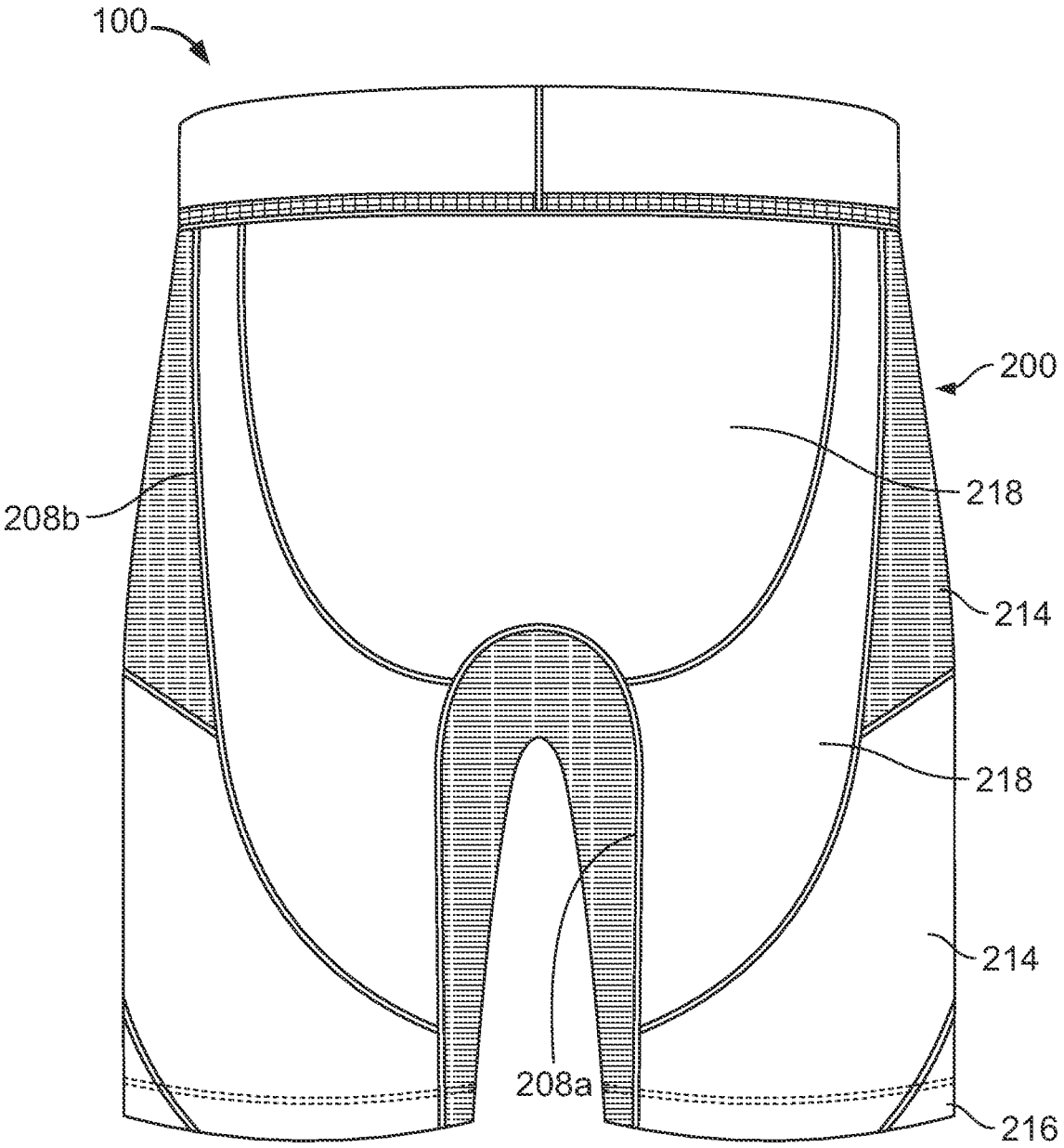
FIG. 9 is a rear elevational view of the performance undergarment of FIG. 8.

FIGS. 10-13 illustrate additional views of the undergarment 200 described in detail with respect to FIGS. 8 and 9. In accordance with the teachings above, although the undergarment 200 is illustrated in a substantially symmetrical form wherein the left and right sides of the undergarment 200 substantially mirror each other, the undergarment 200 need not be provided wherein the undergarment 200 has an exact symmetry.

Figure 14:
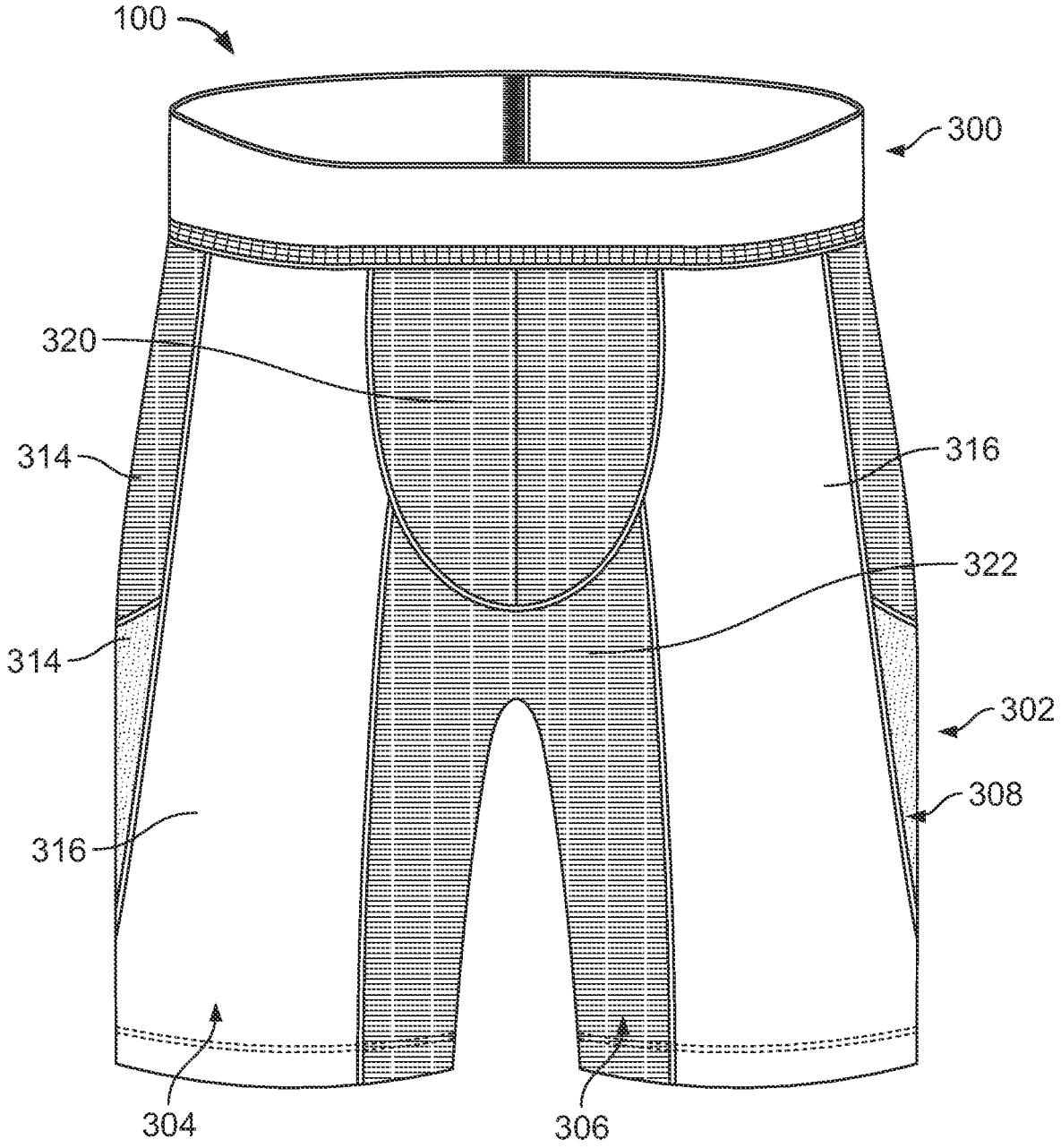
FIG. 14 is a front elevational view of another embodiment of a performance undergarment including the waistband of FIG. 1.
Figure 15:
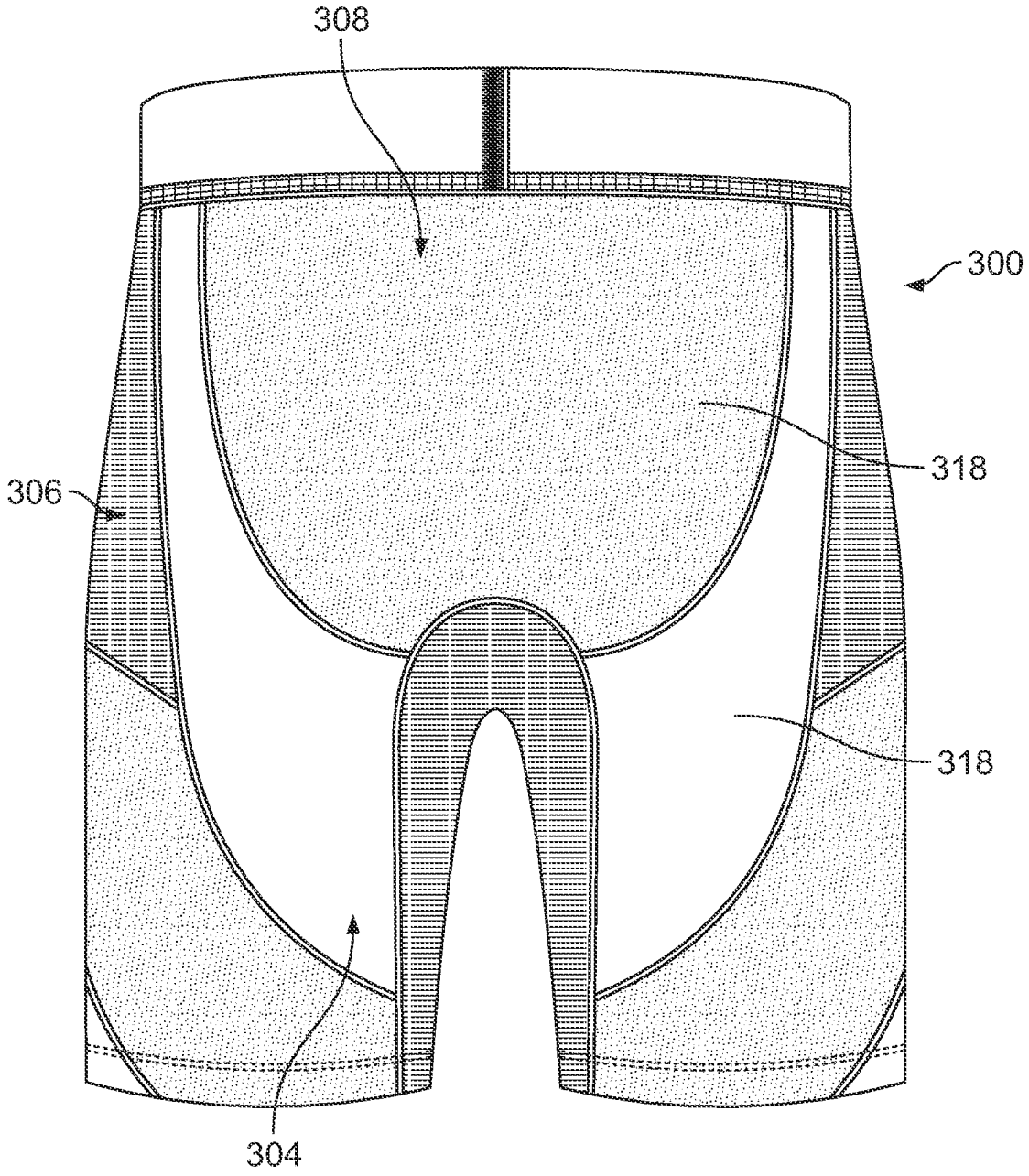
FIG. 15 is a rear elevational view of the performance undergarment of FIG. 14.
Figure 16:
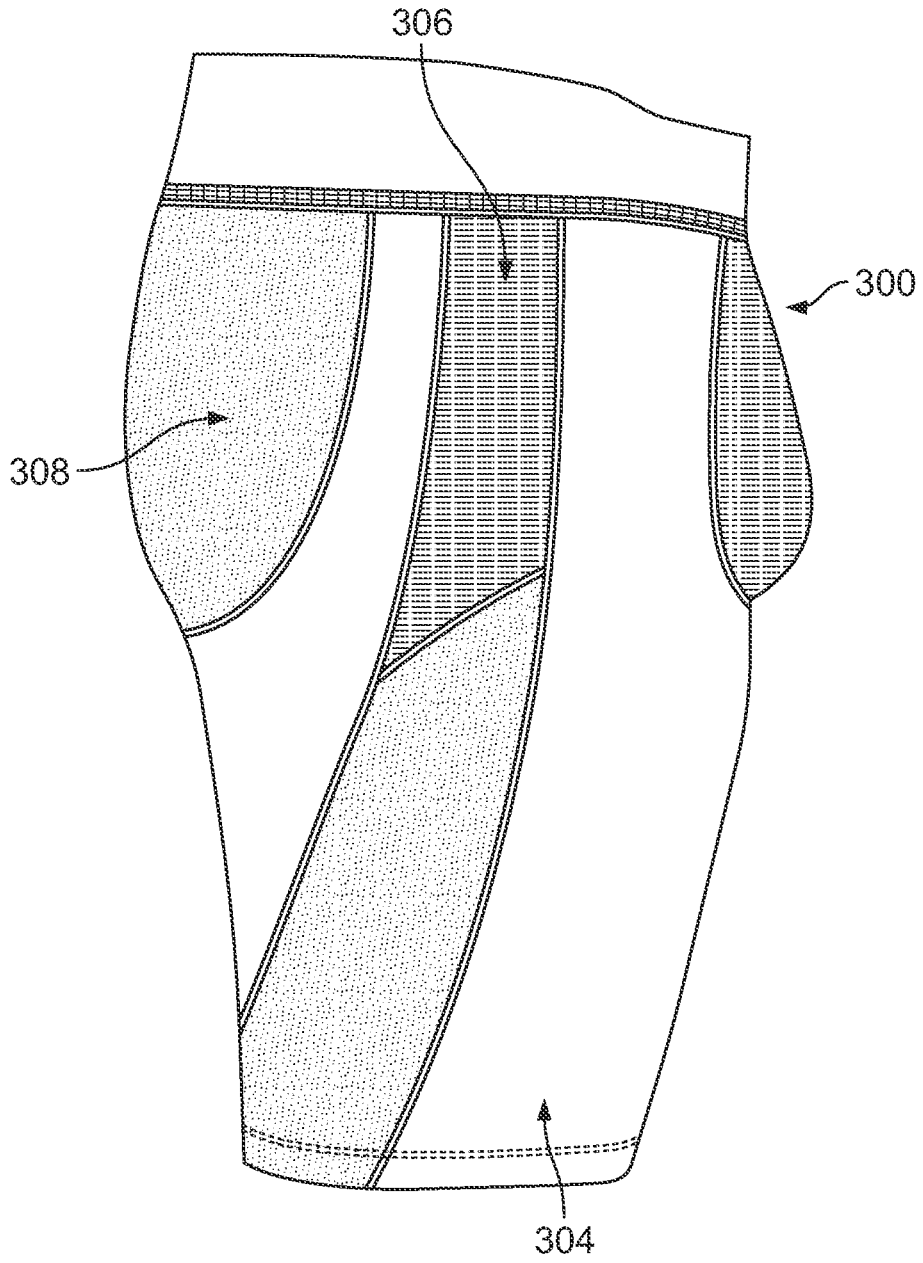
FIG. 16 is a left side elevational view of the performance undergarment of FIG. 14, the right side elevational view being a mirror image thereof.

FIGS. 14-16 illustrate an additional embodiment of an undergarment 300, which is defined by at least three zones. Particularly, the undergarment 300 may be provided in the form of a body 302 including a first zone 304, a second zone 306, and a third zone 308. The waistband 100 may be coupled to the body 302. The zones 304, 306, 308 may be imparted with a first coefficient of friction, a second coefficient of friction, and a third coefficient of friction, respectively, whereby the first coefficient of friction, the second coefficient of friction, and the third coefficient of friction may be different with respect to each other. In the illustrated embodiment, one or more front sections 316 and at least a portion of back sections 318 comprise the first zone 304, at least a portion of side sections 314, a pouch 320, and internal sections 322 comprise the second zone 306, and at least a portion of the side sections 314 and at least a portion of the back sections 318 may comprise the third zone 308. In a preferred embodiment, the second coefficient of friction may be less than the first and/or third coefficients of friction. Alternatively, both the first and third coefficients of friction may be less than the first coefficient of friction.

In some embodiments, the third zone 308 may be distinguishable from the first zone 304 and/or the second zone 306 by a difference in colors of and/or patterns applied to the third zone 308. For example, the third zone 308 may be provided as the same fabric as the first zone 304 and/or the second zone 306, but the third zone 308 may be a different color than the first zone 304 and/or the second zone 306. As an additional example, the third zone 308 may be provided as the same fabric as the first zone 304 and/or the second zone 306, but the third zone 308 may have a different texturing or fabric pattern than the first zone 304 and/or the second zone 306. Furthermore, as would be understood by one skilled in the art, the teachings provided above for the undergarment 200 may also apply to the undergarment 300.

Figure 17:
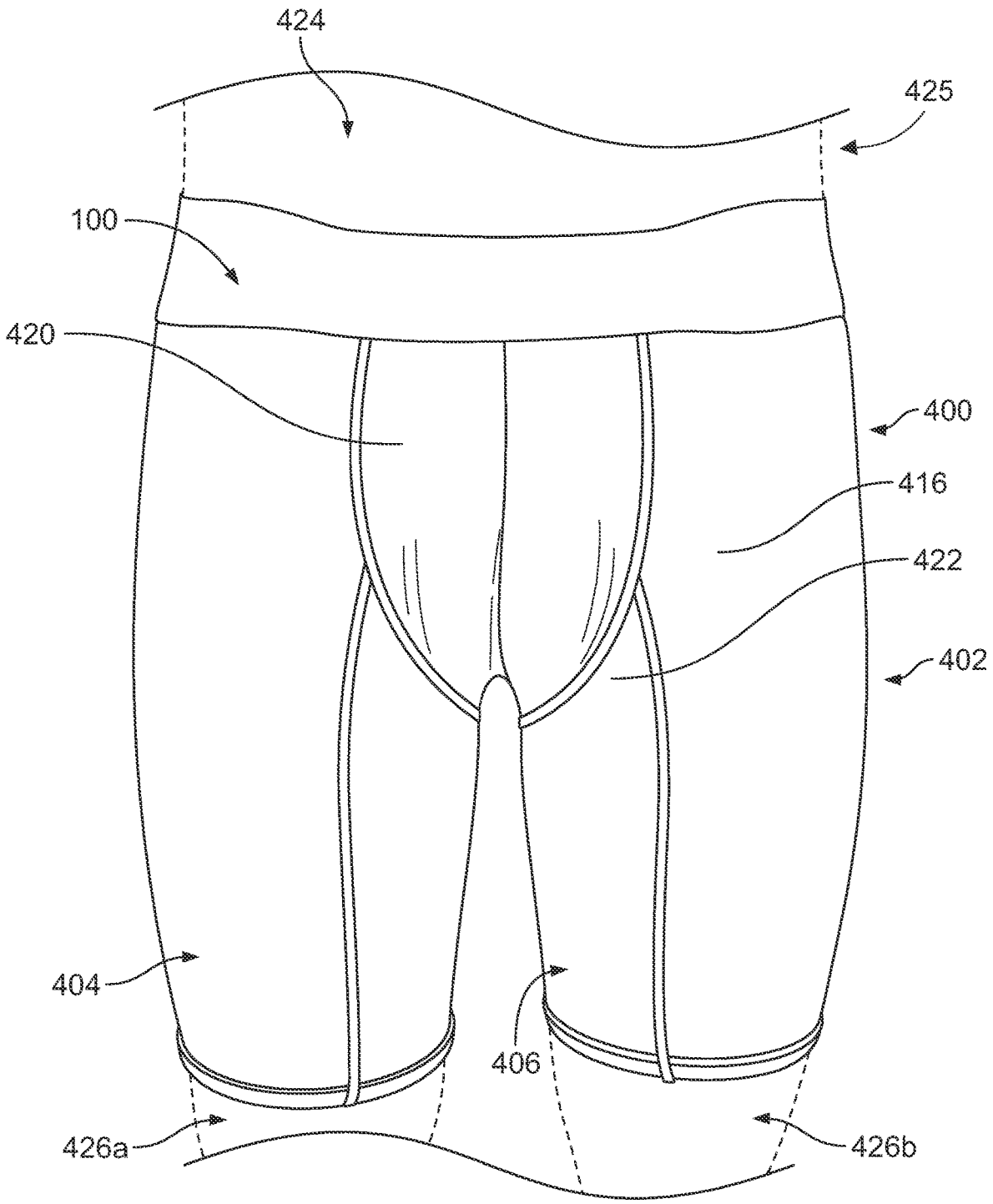
FIG. 17 is a front elevational view of a further embodiment of a performance undergarment including the waistband of FIG. 1.
Figure 18:
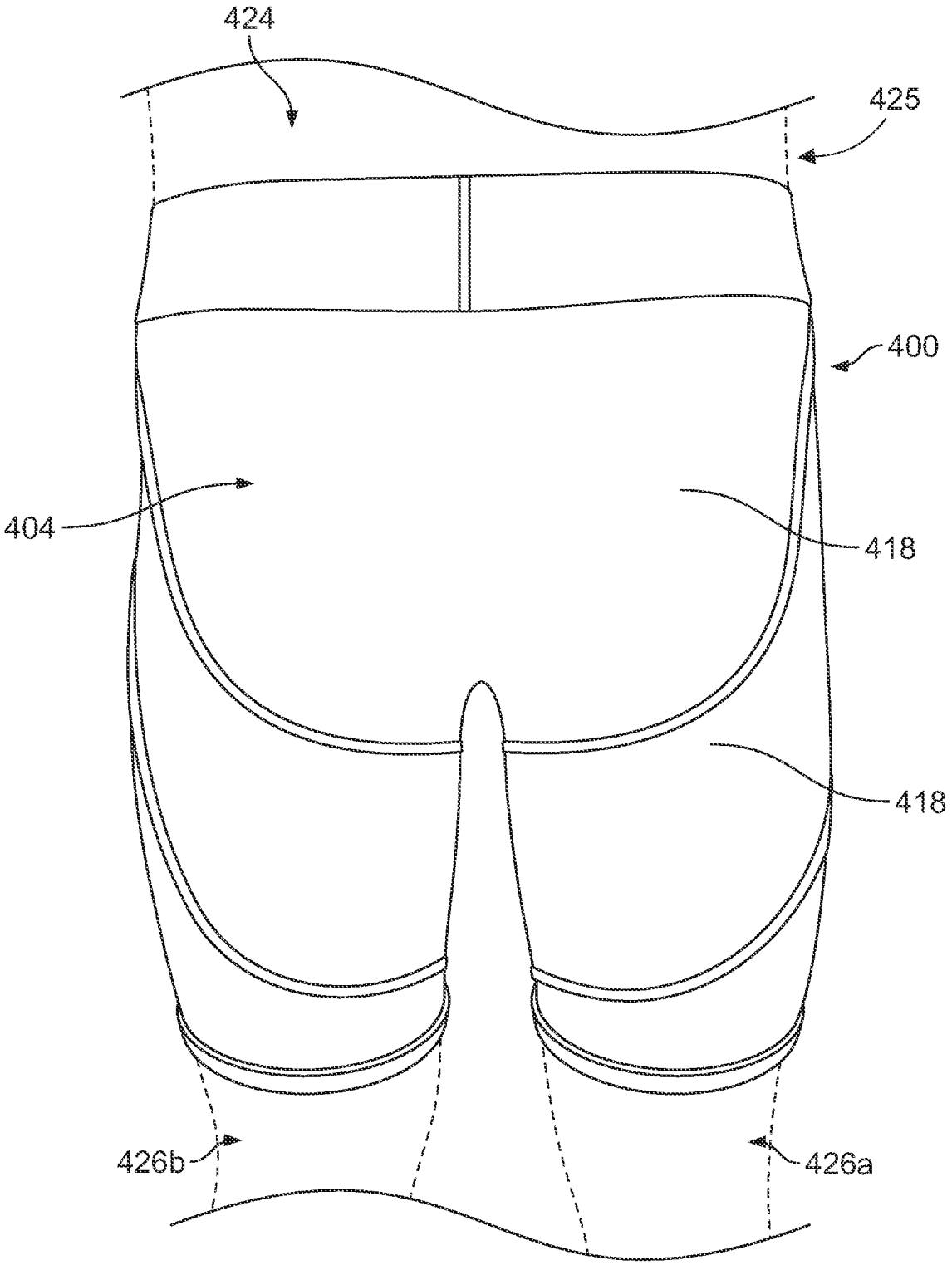
FIG. 18 is a rear elevational view of the performance undergarment of FIG. 17.
Figure 19:
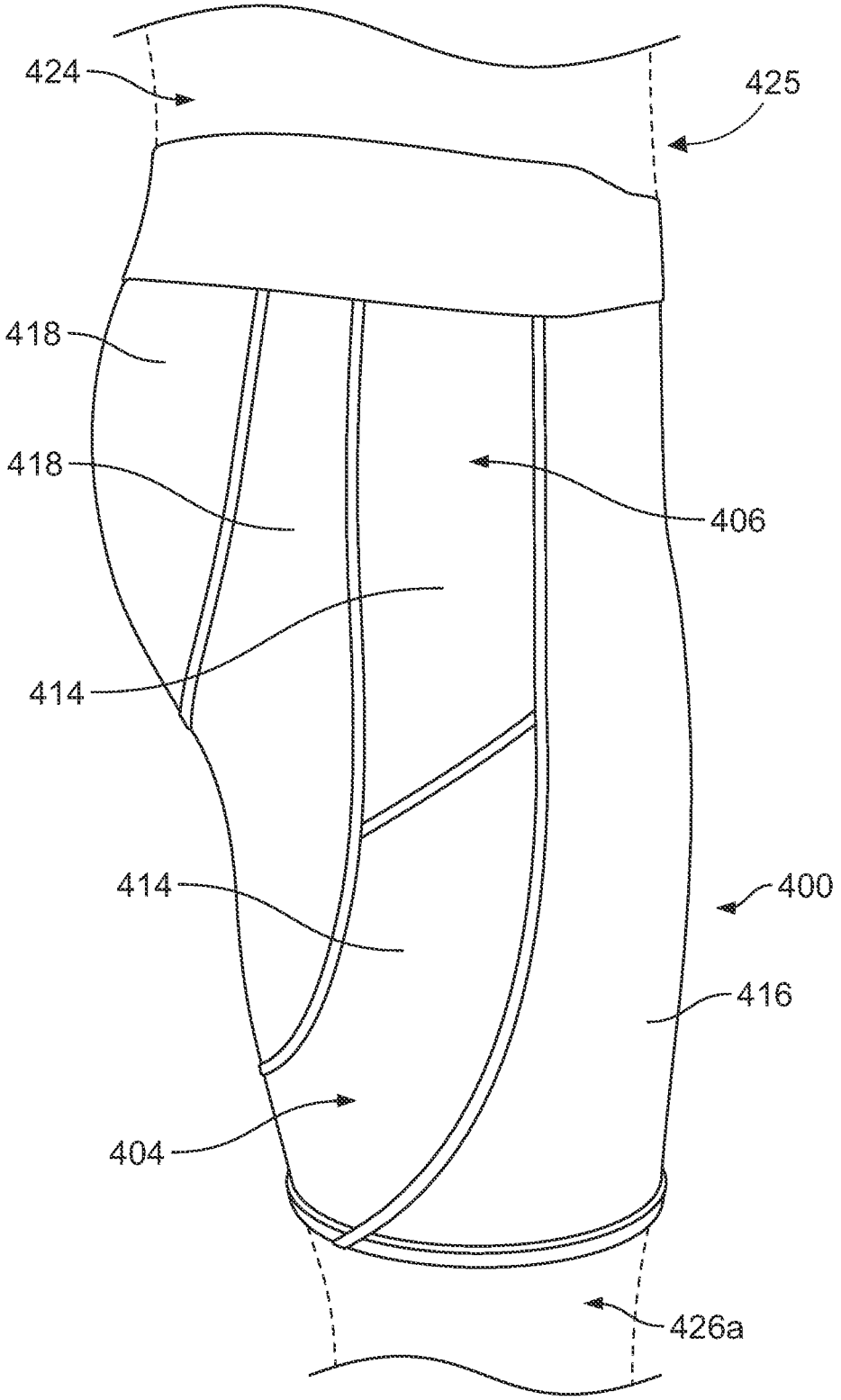
FIG. 19 is a left side elevational view of the performance undergarment of FIG. 17, the right side elevational view being a mirror image thereof.

FIGS. 17-19 illustrate an additional embodiment of an undergarment 400, which is defined by at least two zones. Like the undergarments 200, 300, the undergarment 400 may be defined by a body 402 including a first zone 404 and a second zone 406. In the illustrated embodiment, the first zone 404 comprises at least a portion of side sections 414, front sections 416, and back sections 418, while the second zone 406 comprises at least a portion of the side sections 414, a pouch 420, and internal sections 422. Further, the waistband 100 may be coupled to the body 402. As would be understood by one skilled in the art, the teachings provided above for the undergarments 200, 300 may also apply to the undergarment 400.

In FIGS. 17-19, the waistband 100 is positioned on a lower torso 424 of a wearer 425. More specifically, the waistband 100 (and the undergarment 400 as a whole) surrounds at least a portion of the lower torso 424 of the wearer 425. Furthermore, the undergarment 400 is worn by a wearer and legs **426*a* and 426*b* of the wearer 425 may be positioned through each leg opening of the undergarment 400**.

Figure 20:
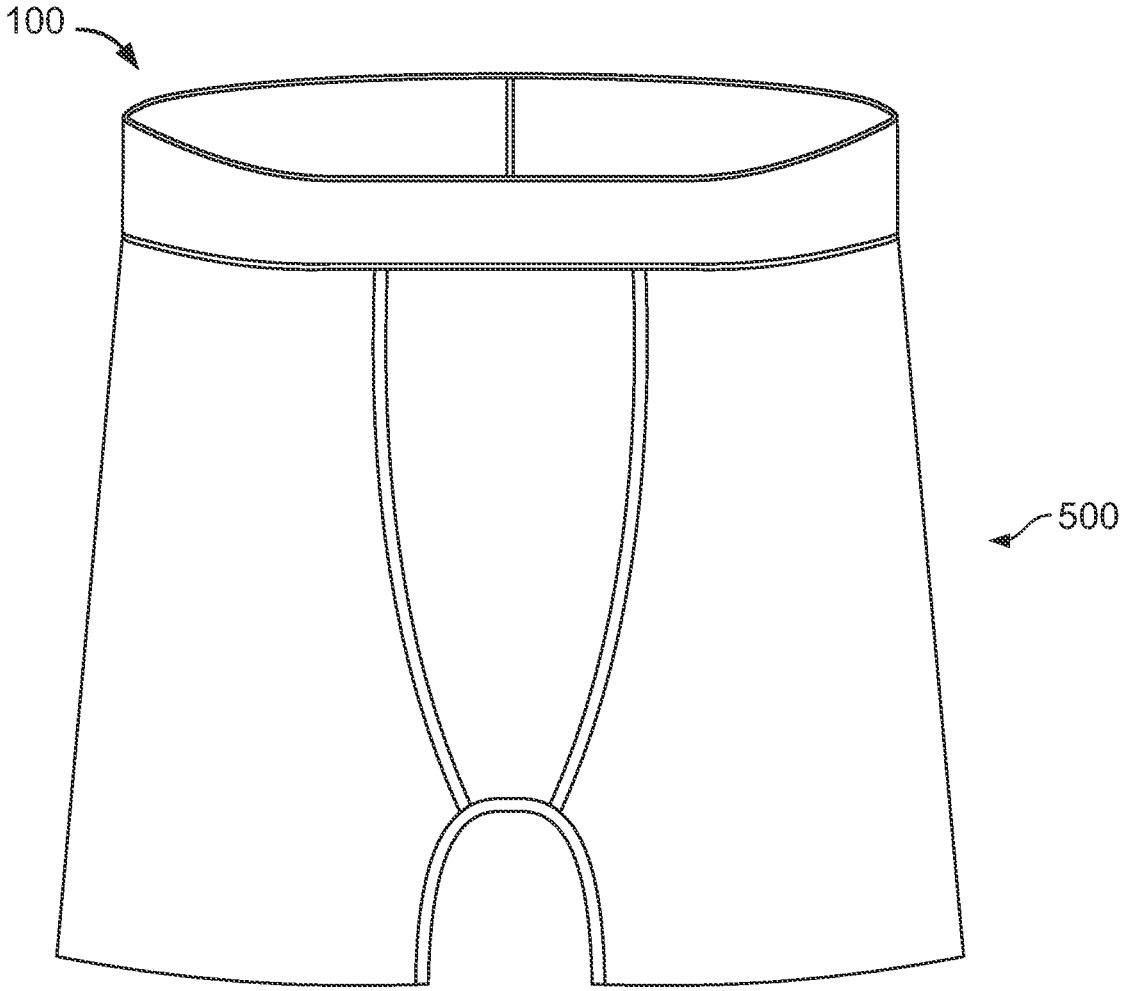
FIG. 20 is a front elevational view of another embodiment of an undergarment including the waistband of FIG. 1.
Figure 21:
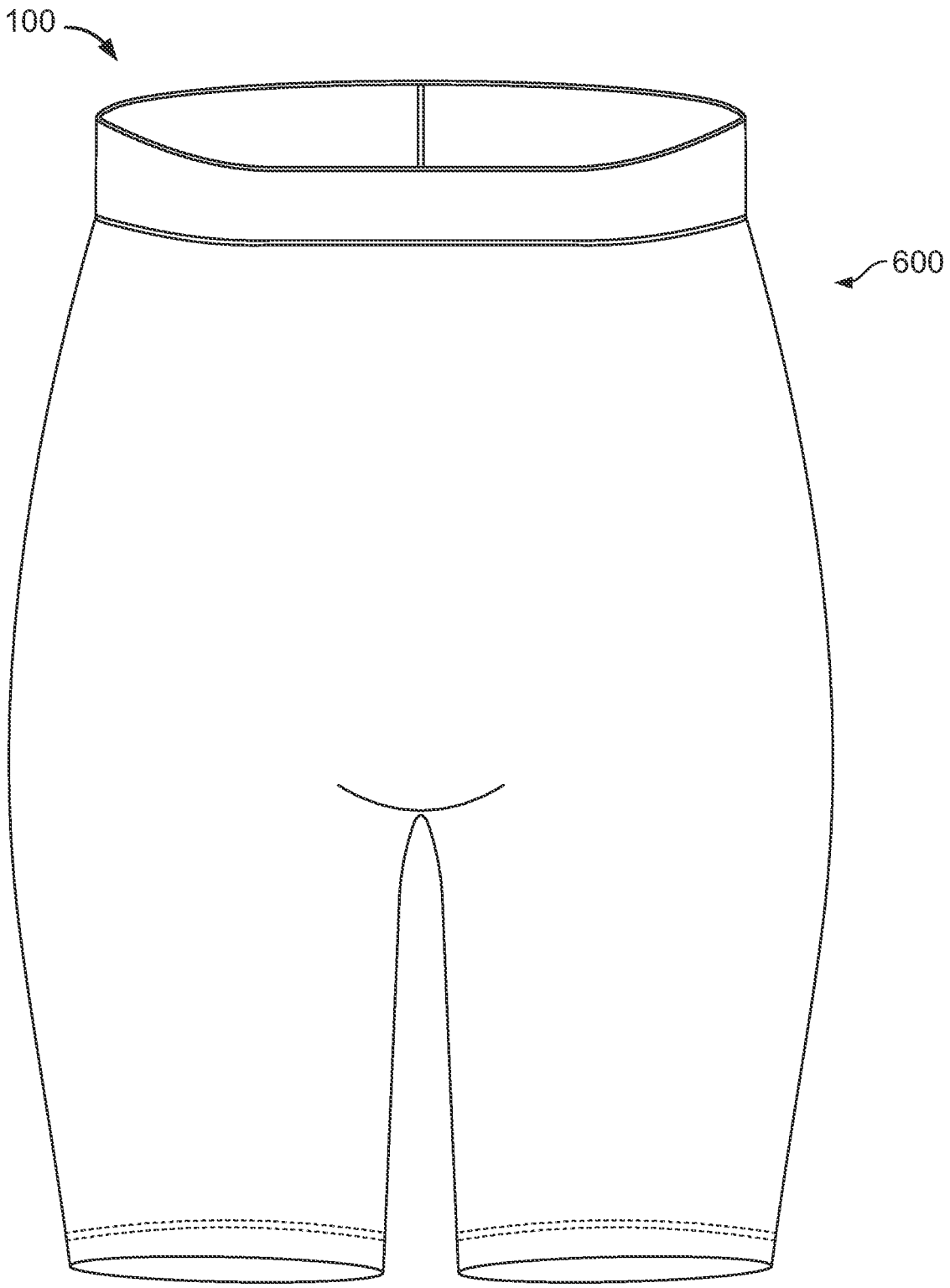
FIG. 21 is a front elevational view of a lower torso garment including the waistband of FIG. 1.
Figure 22:
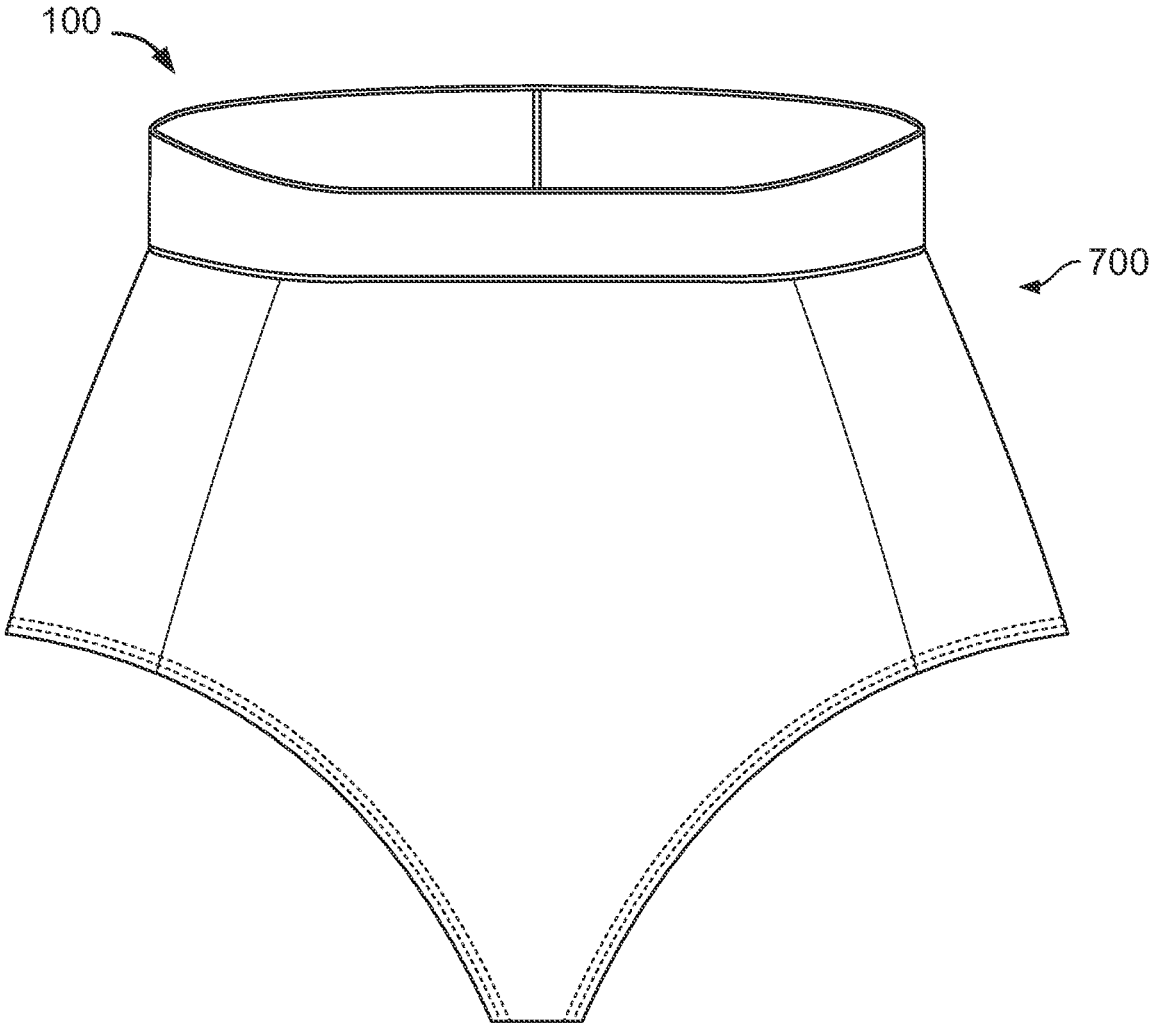
FIG. 22 is a front elevational view of an additional embodiment of an undergarment including the waistband of FIG. 1.
Figure 23:
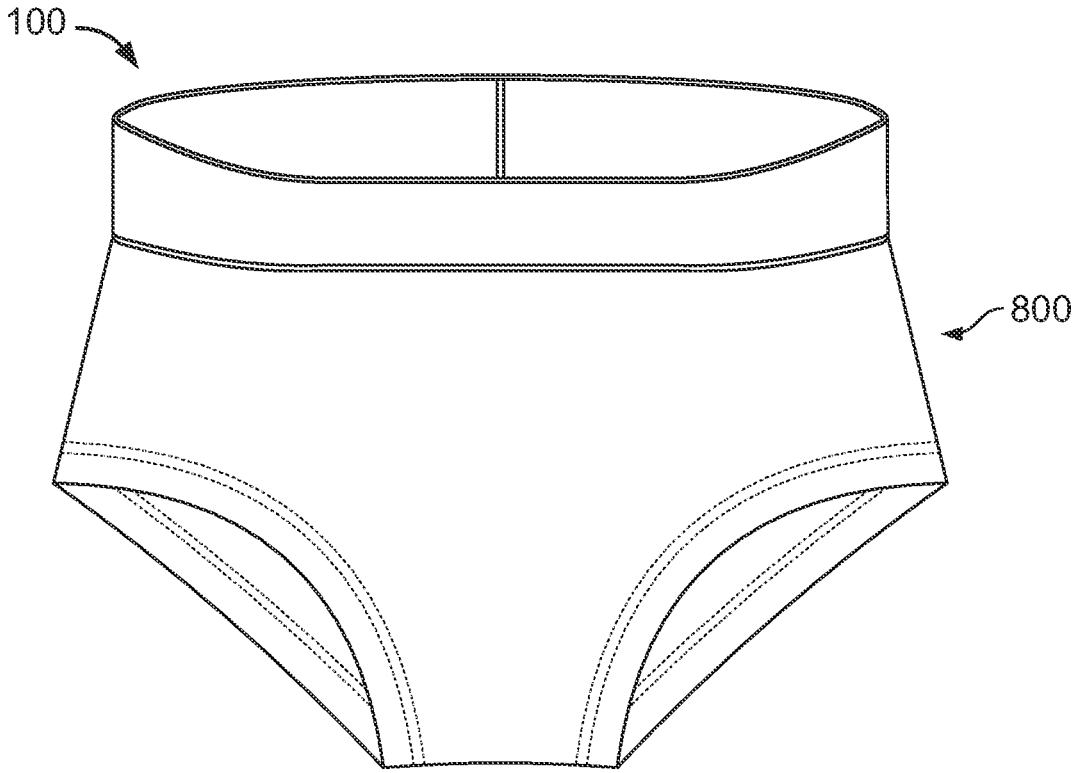
FIG. 23 is a front elevational view of another embodiment of an undergarment including the waistband of FIG. 1.
Figure 24:
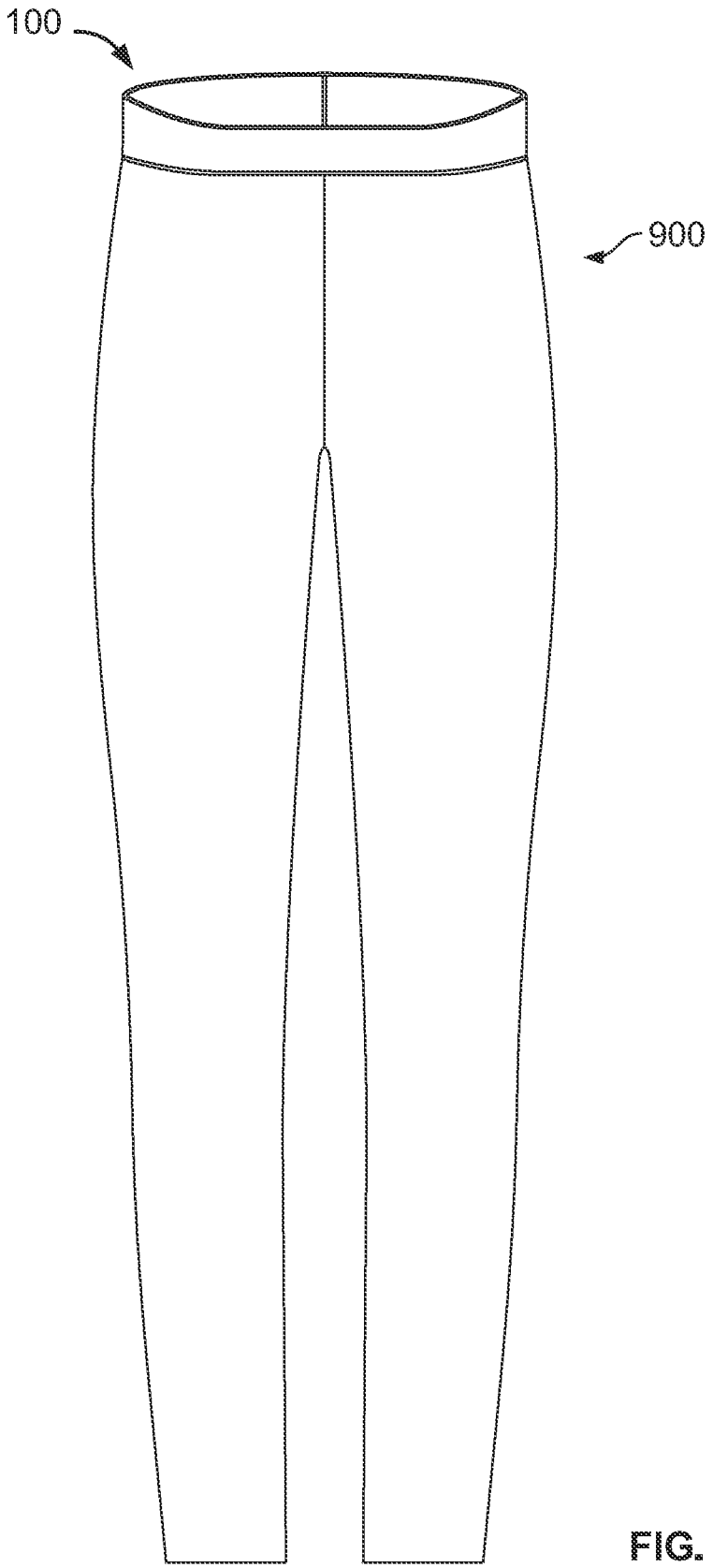
FIG. 24 is a front elevational view of a further embodiment of a lower torso garment including the waistband of FIG. 1.
Figure 25:
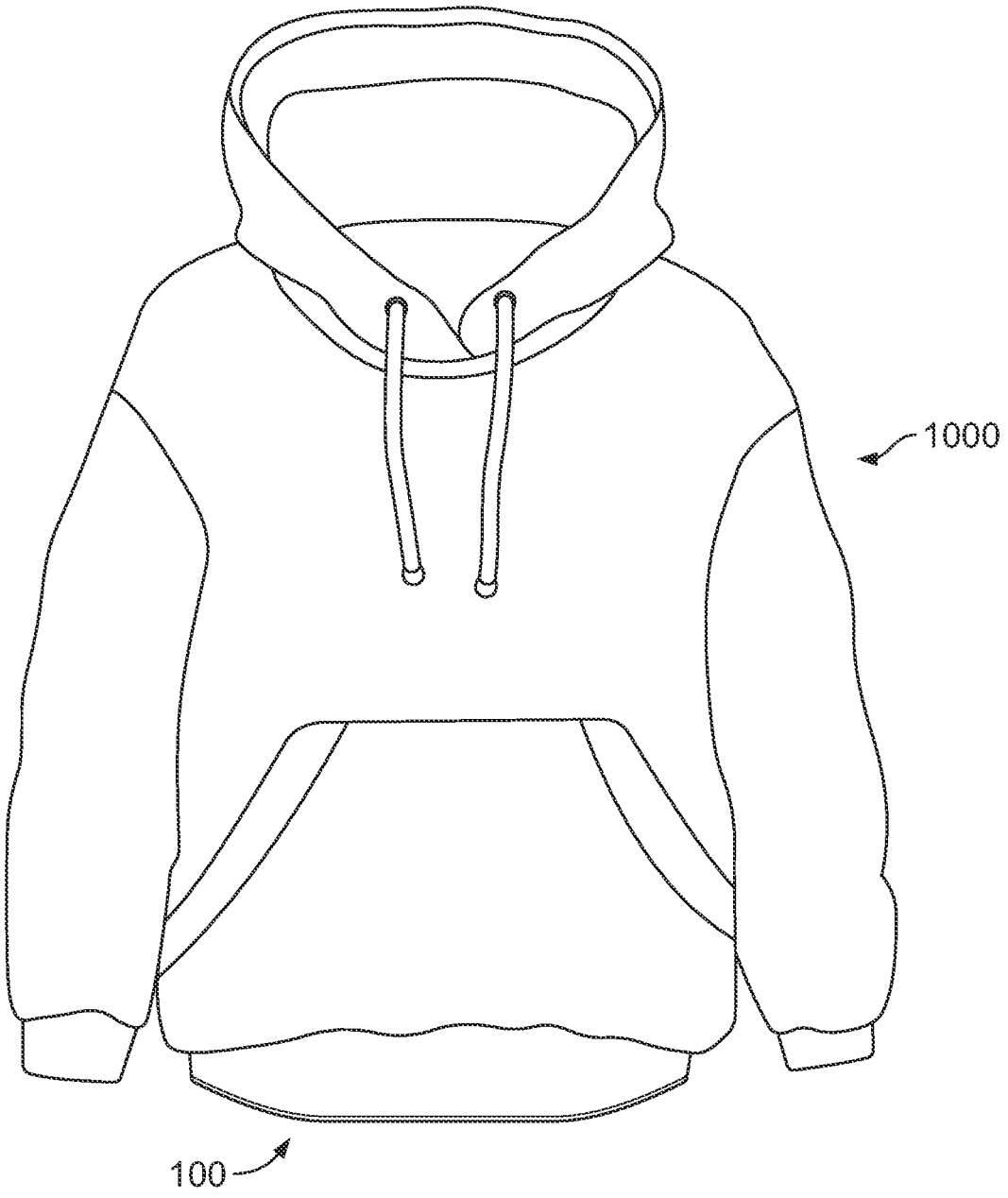
FIG. 25 is a front elevational view of an upper torso garment including the waistband of FIG. 1.

FIGS. 20-25 illustrate additional, non-limiting embodiments that may include the waistband 100 of FIG. 1, the waistband 100 constructed in accordance with the present disclosure. As illustrated in FIG. 20, the waistband 100 may be provided as part of an undergarment 500 provided in the form of a boxer brief. Turning to FIG. 21, the waistband 100 may be provided as part of a lower torso garment 600 provided in the form of athletic or compression shorts. As illustrated in FIG. 22, the waistband 100 may be provided as part of a lower undergarment 700 provided in the form of panties. Referring to FIG. 23, the waistband 100 may be provided as part of an undergarment 800 provided in the form of a brief. Turning to FIG. 24, the waistband 100 may be provided as part of a lower torso garment 900 provided in the form of leggings, shorts, or compression pants. As illustrated in FIG. 25, the waistband 100 may be provided as part of an upper torso garment 1000 provided in the form of a sweater or hoodie. In this instance, the waistband 100 is provided at a bottom end of the garment 1000 such that the waistband 100 is positioned adjacent the wearer's abdomen when the garment 1000 is being worn. Each of the garments illustrated in FIGS. 20-25 may be sold or marketed as a women's garment, a men's garment, and/or a gender-neutral garment.

Figure 26:
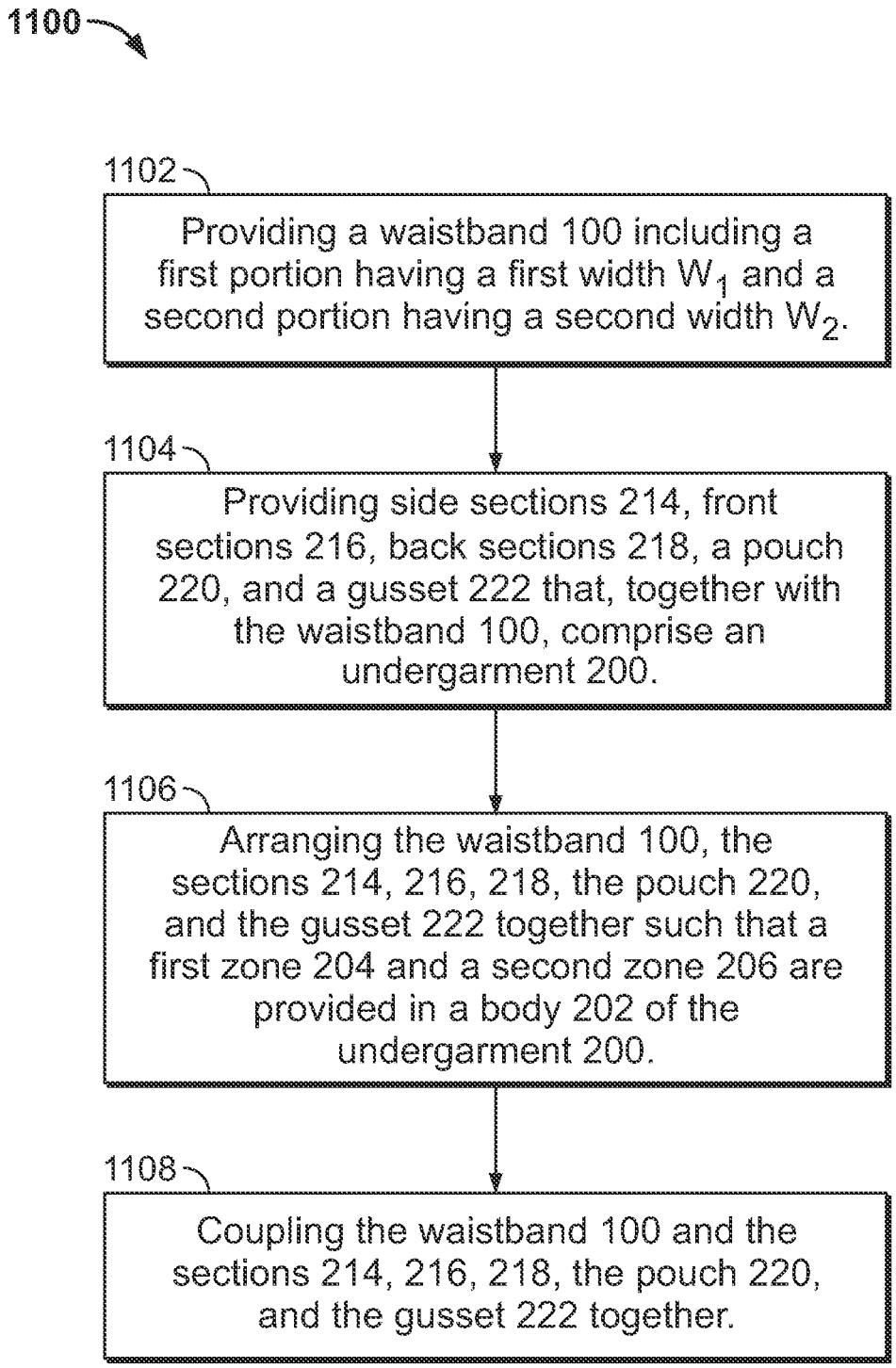
FIG. 26 is a schematic representation of a method that can produce a performance undergarment constructed in accordance with the teachings herein.

As illustrated in FIG. 26, a method 1100 of creating any of the garments 200, 300, 400, 500, or any lower torso garment including a pouch, is provided. For example, the method 1100 may comprise a step 1102 of providing the waistband 100 including a first portion imparted with a first width $W_1$ dimension and a second portion imparted with a second width $W_2$ dimension. The method 1100 may further comprise a step 1104 of providing side sections 214, front sections 216, back sections 218, a pouch 220, and the internal sections 222 that, together with the waistband 100, comprise an undergarment 200. The method 1100 may also comprise a step 1106 of arranging the waistband 100, the sections 214, 216, 218, the pouch 220, and the internal sections 222 together such that the first zone 204 and the second zone 206 are provided in the body 202 of the undergarment 200. The method 1100 may further comprise a step 1108 of coupling the waistband 100 and the sections 214, 216, 218, the pouch 220, and the internal sections 222 together to form the undergarment 200. In some embodiments of the method 1100, the first width $W_1$ dimension may be less than the second width $W_2$ dimension. In other embodiments of the method 1100, the first zone 204 may be imparted with a first coefficient of friction that is greater than a second coefficient of friction of the second zone 206. In some such embodiments, the first zone includes the front section and at least a portion of the back section, and the second zone includes the pouch, the gusset, and at least a portion of the side section.

In other embodiments of the method 1100, the method 1100 may further include the step of coupling the sections 214, 216, 218, the pouch 220, and the internal sections 222 with one or more seams 208 to form the undergarment 200.

In some embodiments of the method 1100, the waistband 100 may be provided in the form of a braided elastic, a knit elastic, a woven elastic, a fold-over elastic, or the like.

In other embodiments of the method 1100, the waistband 100 may include a transition portion positioned between the first and second portions. In some such embodiments, the transition portion may be imparted with a third width dimension.

In some embodiments of the method 1100, the waistband 100 may be coupled to the body of the undergarment via a seam, adhesive, bonding or strip, or similar mechanism known in the art.

The method 1100 may further comprise additional steps consistent with the teachings disclosed herein. In addition, the method 1100 may also comprise fewer steps than those described above. Further, the method 1100 may be adapted to create any of the other garments described herein.

In addition, a method of creating garments according to the disclosure herein, is provided. The method may comprise a step of providing at least one of a side section, a front section, and a back section that, together with the waistband 100, comprise a garment. The method may also comprise a step of arranging the waistband 100, and the provided side, front, and back sections together to provide a body of the garment. The method may further comprise a step of coupling the waistband 100 and the provided side, front, and back sections to form the garment. In some embodiments of the method, the first width $W_1$ dimension of the waistband 100 may be less than the second width $W_2$ dimension of the waistband 100. In other embodiments of the method, the garment may be provided with a first zone and a second zone. In some such embodiments, the first zone may be imparted with a first coefficient of friction that is greater than a second coefficient of friction of the second zone. In yet other embodiments of the method, the method may further include the step of coupling the waistband 100 and the provided side, front, and back sections with one or more seams. In some embodiments of the method, a pouch may be provided in the constructed garment. In other embodiments of the method, a gusset may be provided in the constructed garment.

The method may further comprise additional steps consistent with the teachings disclosed herein. In addition, the method may also comprise fewer steps than those described above.

EXAMPLES

An example construction of the waistband 100, which embodies the teachings described herein, is provided. In a preferred embodiment of the flexible body 102 of the waistband 100, the flexible body 102 may comprise the following:

| Yarn Content (% of Fabric) | Yarn Type | Yarn Component Details | Count/ Denier/ Filament | Number of Ends |
|---|---|---|---|---|
| 64% | Nylon | Stretch Nylon | 2/70/24 | 444 |
| 1% | Nylon | Stretch Nylon | 1/70/24 | 24 |
| 17% | Polyester | Textured Polyester | 1/150/48 | 1 |
| 1% | Nylon | Stretch Nylon | 1/70/24 | 1 |
| 7% | Polyester | Textured Polyester | 1/75/36 | 100 |
| 1% | Spandex | Spandex | 105D | 24 |
| 9% | Spandex | Spandex | 560D | 50 |

It will be appreciated by those skilled in the art that while the above disclosure has been described above in connection with particular embodiments and examples, the above disclosure is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the above disclosure are set forth in the following claims.

We claim:

1. A waistband for use in a garment, comprising:

a flexible body including:

a first portion imparted with a first width dimension, a first length dimension, and a first thickness dimension;

a second portion imparted with a second width dimension, a second length dimension, and a second thickness dimension; and a first transition portion extending from the first portion to the second portion, the first transition portion imparted with a third width dimension, a third length dimension, and a third thickness dimension that increases from the first portion to the second portion, wherein:

the second portion extends from the first transition portion and around a majority of a circumference of the flexible body, the first width dimension is about 5%-35% smaller than the second width dimension, and the third width dimension of the first transition portion gradually tapers between the first portion and the second portion, the second length dimension is greater than both the first and third length dimensions, the second thickness dimension along an entirety of the second length dimension of the second portion is greater than both the first and third thickness dimensions, and the third thickness dimension is greater than the first thickness dimension.

2. The waistband of claim 1, wherein the first width dimension is about 10%-5% smaller than the second width dimension.

3. The waistband of claim 1, wherein the waistband further comprises an attachment mechanism designed to couple a first end and a second end of the second portion.

4. The waistband of claim 3, wherein the attachment mechanism is provided in the form of at least one of a flatseam, an adhesive, a bonding strip, or a thread.

5. The waistband of claim 1, wherein the waistband is seamless.

6. The waistband of claim 1, wherein, the waistband is imparted with an ovular shape when the waistband is in a closed configuration.

7. The waistband of claim 1, wherein the first transition portion further includes a fourth width dimension and a fifth width dimension, the fourth width dimension approximately equal to the first width dimension and the fifth width dimension approximately equal to the second width dimension, and wherein the fourth width dimension gradually increases to the fifth width dimension.

8. The waistband of claim 1, wherein the flexible body further includes a second transition portion extending from a second end of the first portion to the second portion, the second transition portion imparted with a fourth width dimension, a fourth length dimension and a fourth thickness dimension and the first transition portion is positioned relative to a lateral end of the first portion and the second transition portion is positioned relative to an opposing lateral end of the first portion.

9. The waistband of claim 8, wherein: the first portion includes a left lateral edge and a right lateral edge, the first portion couples to the first transition portion and the second transition portion at a left lateral edge and a right lateral edge, respectively, the first transition portion and the second transition portion each join to the second portion at a respective interfacing edge of the second portion.

* * * * *